US009746818B2

(12) United States Patent
Uchino et al.

(10) Patent No.: US 9,746,818 B2
(45) **Date of Patent: *Aug. 29, 2017**

(54) IMAGE FORMING PROCESS

(71) Applicant: Konica Minolta, Inc., Tokyo (JP)

(72) Inventors: Satoshi Uchino, Hino (JP); Kosuke Nakamura, Hachioji (JP); Futoshi Kadonome, Hachioji (JP); Koji Shibata, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/683,818

(22) Filed: Apr. 10, 2015

(65) Prior Publication Data

US 2015/0316889 A1 Nov. 5, 2015

(30) Foreign Application Priority Data

Apr. 30, 2014 (JP) ..... 2014-093498

(51) Int. Cl.

| | |
|---|---|
| ***G03G 13/08*** | (2006.01) |
| ***G03G 21/00*** | (2006.01) |
| ***G03G 9/087*** | (2006.01) |
| ***G03G 9/097*** | (2006.01) |

(52) U.S. Cl.

CPC ..... *G03G 21/0094* (2013.01); *G03G 9/08724* (2013.01); *G03G 9/08755* (2013.01); (Continued)

(58) Field of Classification Search

CPC ..... G03G 9/09725; G03G 9/08755; G03G 9/08724; G03G 9/08773

USPC ..... 430/105, 123.51, 108.3

See application file for complete search history.

(56) References Cited

U.S. PATENT DOCUMENTS

2005/0084271 A1* 4/2005 Koike ..... G03G 15/5033 399/12

2007/0117033 A1 5/2007 Sugino (Continued)

FOREIGN PATENT DOCUMENTS

JP 2002278093 A 9/2002

JP 2008-257011 A 10/2008

(Continued)

OTHER PUBLICATIONS

Machine Translation of JP2011-257526 (pp. 1-17).*

(Continued)

*Primary Examiner* — Thorl Chea

(74) *Attorney, Agent, or Firm* — Lucas & Mercanti, LLP

(57) ABSTRACT

A process of forming an image includes the steps of: developing an electrostatic latent image with a toner, the latent image being formed through charge of the surface of an electrostatic latent image carrier and exposure of the surface to light; and applying a lubricant onto the surface of the electrostatic latent image carrier. The toner includes a toner matrix particle and an external additive nanoparticle. The external additive nanoparticle comprises a silica-polymer composite nanoparticle. A percentage of atomic silicon present on the surface of the silica-polymer composite nanoparticle satisfies Condition A expressed by Expression: 15.0 atm %≤percentage of atomic silicon ({Si/(C+O+Si)}×100)≤30.0 atm %. The percentage of atomic silicon is determined from total amounts of atomic carbon, oxygen, and silicon present on the topmost surface of the silica-polymer composite nanoparticle and within 3 nm inwards from the topmost surface.

9 Claims, 3 Drawing Sheets

(52) U.S. Cl.
CPC ..... *G03G 9/08773* (2013.01); *G03G 9/09716* (2013.01); *G03G 9/09725* (2013.01)

(56) References Cited

U.S. PATENT DOCUMENTS

| | | | | |
|---|---|---|---|---|
| 2014/0295341 | A1* | 10/2014 | Fomitchev ..... | G03G 9/09716<br>430/108.22 |
| 2015/0064616 | A1 | 3/2015 | Sekiguchi | |

FOREIGN PATENT DOCUMENTS

| | | | |
|---|---|---|---|
| JP | 2010113017 | A | 5/2010 |
| JP | 2010-210799 | A | 9/2010 |
| JP | 2011095356 | A | 5/2011 |
| JP | 2011257526 | A | 12/2011 |
| JP | 2012070837 | A | 4/2012 |
| JP | 2012120747 | A | 6/2012 |
| WO | 2013063291 | A1 | 5/2013 |

OTHER PUBLICATIONS

Notification of Reasons for Refusal dated Apr. 5, 2016; Patent Application No. 2014-093498; English translation of Notification of Reasons for Refusal; total of 10 pages.
Office Action dated Sep. 6, 2016 from corresponding Japanese application; Patent Application No. 2014-093498; Applicant: Konica Minolta, Inc.; English translation of Office Action; total of 7 pages.

* cited by examiner

IMAGE FORMING PROCESS

CROSS REFERENCE TO RELATED APPLICATION

This Application claims the priority of Japanese Patent Application No. 2014-093498 filed on Apr. 30, 2014, which is incorporated by reference herein.

BACKGROUND OF THE INVENTION

1. Field of the Invention

The present invention relates to processes of forming images, in particular an electrophotographic process of forming images, the process comprising a step of applying a lubricant and being capable of forming high-quality images without defects over a long time.

2. Description of Related Art

Electrophotographic imaging apparatuses form toner images on transfer media by repetition of a series of steps, such as charging of photoreceptors, developing of images, and transfer of images. Electrostatic latent image carriers (also referred to as "electrophotographic photoreceptors" or merely "photoreceptors") included in the electrophotographic imaging apparatuses have residues adhering to their surfaces during the series of steps, such as residual toners not transferred onto transfer media (also referred to as "untransferred toner"), external additives contained in developers, and dust.

To remove such residues, the electrophotographic imaging apparatuses each include a cleaning blade disposed in pressing contact with the surface of the electrostatic latent image carrier to remove these residues, so that the electrophotographic imaging apparatuses can repeatedly form high-quality clear images.

Increasing demands for high-definition high-quality images lead to use of toners having small particle diameters prepared by polymerization, such as dissolution suspension or emulsion polymerization aggregation. These toners having small particle diameters have large adhesive force to the surfaces of electrostatic latent image carriers, and readily remain on their surfaces in the form of residues, such as untransferred toner. If the cleaning blade is pressed against the electrostatic latent image carrier more strongly to remove residues, a large frictional force is generated between the electrostatic latent image carrier and the cleaning blade, and gradually abrades the surface of the electrostatic latent image carrier.

To avoid such wear, an imaging apparatus is disclosed that includes a lubricant applicator to apply a lubricant onto the surface of an electrostatic latent image carrier, for reducing the frictional force between the electrostatic latent image carrier and a cleaning blade to reduce wear of the surface of the electrostatic latent image carrier during removal of residues left on the surface of the electrostatic latent image carrier (for example, see Japanese Patent Application Laid-Open No. 2010-210799).

If a lubricant is unevenly applied onto the surface of the electrostatic latent image carrier, the electrostatic latent image carrier is also unevenly charged. Such uneven charge of the electrostatic latent image carrier causes defects in images.

Accordingly, it is desirable that the lubricant be uniformly applied onto the surface of the electrostatic latent image carrier in a sufficient amount to prevent wear of the surface of the electrostatic latent image carrier.

Unfortunately, the lubricant applicator inevitably causes uneven application of the lubricant during long-term image forming operations, and thus precludes long-term stable formation of images.

SUMMARY OF THE INVENTION

The present invention has been achieved in consideration of the problems and the circumstances described above. An object of the present invention is to provide a process of forming an image involving a step of applying a lubricant. This process can form high-quality images without defects, caused by uneven charge of an electrostatic latent image carrier, over a long time.

The present inventor, who has investigated the causes of the problems, has found that the problems can be solved by use of a toner containing silica-polymer composite nanoparticles as an external additive in a process of forming an image involving a step of applying a lubricant, and has achieved the present invention.

In order to realize the above object, according to a first aspect of the present invention, there is provided a process of forming an image, including at least the steps of:

developing an electrostatic latent image with a toner, the latent image being formed through charge of the surface of an electrostatic latent image carrier and exposure of the surface to light; and applying a lubricant onto the surface of the electrostatic latent image carrier, wherein the toner includes at least a toner matrix particle and an external additive nanoparticle, the external additive nanoparticle includes a silica-polymer composite nanoparticle, and a percentage of atomic silicon present on the surface of the silica-polymer composite nanoparticle satisfies at least Condition A expressed by Expression: 15.0 atm %≤percentage of atomic silicon ({Si/(C+O+Si)}×100)≤30.0 atm %, the percentage of atomic silicon being determined from total amounts of atomic carbon, oxygen, and silicon present on the topmost surface of the silica-polymer composite nanoparticle and within 3 nm inwards from the topmost surface, the percentages of the atoms being determined with an X-ray photoelectron spectrometer.

Preferably, the number average primary particle diameter of the silica-polymer composite nanoparticle is within the range of 50 to 500 nm.

Preferably, the toner includes a toner matrix particle having a domain-matrix structure, the matrix contains a vinyl resin having acid groups, and the domain contains a resin composed of a vinyl polymer segment and a polyester polymer segment combined together.

Preferably, a hydrophobic agent used in the silica-polymer composite nanoparticle includes at least methacryloxypropyltrimethoxysilane.

Preferably, a hydrophobic agent used in the silica-polymer composite nanoparticle includes at least hexamethyldisilazane.

Preferably, the silica-polymer composite nanoparticle has a silica portion composed of a colloidal silica nanoparticle.

Preferably, the silica portion of the silica-polymer composite nanoparticle has a particle diameter of 10 to 70 nm.

Preferably, the toner matrix particle included in a toner particle has a number average particle diameter of 3 to 8 μm.

Preferably, the toner matrix particle included in the toner particle has an average circularity of 0.850 to 0.990.

Preferably, the lubricant is zinc stearate.

Effects of the Invention

The present invention can provide a process of forming an image that involves a step of applying a lubricant. The process can prevent defects of images caused by uneven charge of an electrostatic latent image carrier and thus can form high-quality images over a long time.

Although the mechanism has not been clarified, the inventor infers the reason for the advantageous effects of the present invention as follows.

In the process of forming an image according to the present invention, the toner comprises a silica-polymer composite nanoparticle as an external additive nanoparticle. The silica-polymer composite nanoparticles have a polishing effect, which acts on the lubricant applied onto the electrostatic latent image carrier to forma uniform coating of the lubricant on the electrostatic latent image carrier. This is probably because the silica-polymer composite nanoparticles appropriately demonstrate the polishing effect in the contact portion between the electrostatic latent image carrier and a cleaning blade to remove excess lubricant.

It is also believed that wear of the cleaning blade or the surface of the electrostatic latent image carrier can be prevented by a lubricating effect of the uniformly applied lubricant and the polymer portions of the silica-polymer composite nanoparticles which absorb excess pressure.

Namely, specific silica-polymer composite nanoparticles remove excess lubricant applied onto the surface of the electrostatic latent image carrier to form a uniform coating of the lubricant, and prevent wear of the electrostatic latent image carrier without damaging the cleaning blade, so that high-quality images can be stably formed for a long period of time without contamination of images due to uneven charge of the electrostatic latent image carrier caused by excess lubricant.

If only silica, titania, calcium titanate, calcium titanate, or strontium titanate known as a typical polisher is used as external additive nanoparticles, these compounds can function as a polisher to remove excess lubricant. Such a sole use of these compounds, however, damages the electrostatic latent image carrier and the cleaning blade, so that high-quality images cannot be stably formed for a long period of time.

BRIEF DESCRIPTION OF THE DRAWINGS

The present invention will become more fully understood from the detailed description given hereinbelow and the appended drawings which are given by way of illustration only, and thus are not intended as a definition of the limits of the present invention, and wherein.

DETAILED DESCRIPTION OF THE PREFERRED EMBODIMENT

Figure 1:
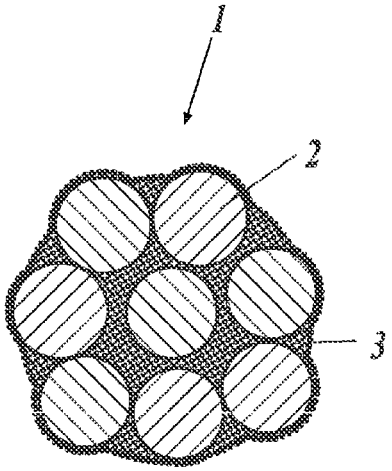
FIG. 1 is a schematic view illustrating an exemplary shape of a nanoparticle of a silica-polymer composite according to the present invention.

Hereinafter, an embodiment of the present invention will be described with reference to the drawings. Though various technical limitations which are preferable to perform the present invention are included in the after-mentioned embodiment, the scope of the invention is not limited to the following embodiment and the illustrated examples.

The process of forming an image according to the present invention comprises at least the steps of:

developing an electrostatic latent image with a toner, the latent image being formed through charge of the surface of an electrostatic latent image carrier and exposure of the surface to light; and applying a lubricant onto the surface of the electrostatic latent image carrier, wherein the toner comprises at least a toner matrix particle and an external additive nanoparticle, the external additive nanoparticle comprises a silica-polymer composite nanoparticle, and a percentage of atomic silicon present on the surface of the silica-polymer composite nanoparticle satisfies at least Condition A expressed by Expression: 15.0 atm %≤percentage of silicon atom ({Si/(C+O+Si)}×100)≤30.0 atm %, the percentage of atomic silicon being determined from total amounts of atomic carbon, oxygen, and silicon present on the topmost surface of the silica-polymer composite nanoparticle and within 3 nm inwards from the topmost surface, the percentages of the atoms being determined with an X-ray photoelectron spectrometer. These technical characteristics are common to claims 1 to 3 of the present invention.

In one embodiment according to the present invention, the number average primary particle diameter of the silica-polymer composite nanoparticle is preferably within the range of 50 to 500 nm for the demonstration of the advantageous effects of the present invention. Silica-polymer composite nanoparticles having a number average primary particle diameter within this range attain an appropriate polishing effect.

The toner preferably comprises a toner matrix particle having a domain-matrix structure, wherein the matrix contains a vinyl resin having acid groups, and the domain contains a resin composed of a vinyl polymer segment and a polyester polymer segment combined together. It is believed that the toner matrix particles having such a domain-matrix structure give a hardness distribution of the surfaces of the toner matrix particles. This hardness distribution appropriately adjusts the adhesion of the silica-polymer composite nanoparticles to the toner matrix particles, and also adjusts the amount of silica-polymer composite nanoparticles detached from the toner matrix particles to function as a polisher.

Components, and embodiments and aspects for implementing the present invention will now be described in detail. Throughout the specification, the term "to" between numeric values indicates that the numeric values before and after the term are inclusive as the lower limit and the upper limit, respectively.

Outline of Process of Forming Image

The process of forming an image according to the present invention comprises at least the steps of developing an electrostatic latent image with a toner, the latent image being formed through charge of the surface of an electrostatic latent image carrier and exposure of the surface to light; and applying a lubricant onto the surface of the electrostatic latent image carrier, wherein the toner comprises at least a toner matrix particle and an external additive nanoparticle, the external additive nanoparticle comprises a silica-polymer composite nanoparticle, and a percentage of atomic silicon present on the surface of the silica-polymer composite nanoparticle satisfies at least Condition A expressed by Expression: 15.0 atm %≤percentage of silicon atom ({Si/(C+O+Si)}×100)≤30.0 atm %, the percentage of atomic silicon being determined from total amounts of atomic carbon, oxygen, and silicon present on the topmost surface of the silica-polymer composite nanoparticle and within 3 nm inwards from the topmost surface, the percentages of the atoms being determined with an X-ray photoelectron spectrometer.

In the process of forming an image according to the present invention, the lubricant can be applied onto the surface of the electrostatic latent image carrier by any method. In the present invention, the lubricant is preferably applied onto the surface of the electrostatic latent image carrier with a lubricant applicator, which rolls on the surface of the electrostatic latent image carrier and the surface of the lubricant. The lubricant and the lubricant applicator will be described later.

The components according to the present invention will now be described in detail.

Silica-Polymer Composite Nanoparticles

The silica-polymer composite nanoparticles according to the present invention are composed of silica nanoparticles and a polymer. The silica-polymer composite nanoparticles are present on the surfaces of the toner matrix particles as an external additive adhering to the surfaces of the toner matrix particles. In the silica-polymer composite nanoparticles, the surfaces of the silica nanoparticles are modified with a first hydrophobic agent. A polymerizable functional group in the first hydrophobic agent, such as a vinyl group or an acryloxy group, is formed into a polymer by polymerization to prepare silica-polymer composite nanoparticles.

FIG. 1 is a schematic view illustrating an exemplary shape of a silica-polymer composite nanoparticle 1 according to the present invention. In FIG. 1, silica nanoparticles 2 and a polymer 3 prepared with the first hydrophobic agent are also illustrated. The silica nanoparticles 2 are dispersed in the polymer 3 and are combined with the polymer 3. The silica nanoparticles 2 are present relatively close to the surface of the silica-polymer composite nanoparticle, and are partially projected from the silica-polymer composite nanoparticle 1. The silica-polymer composite nanoparticles each have such a configuration.

In the silica-polymer composite nanoparticles, a percentage of atomic silicon present on the surface of the silica-polymer composite nanoparticle satisfies at least Condition A expressed by Expression: 15.0 atm %≤percentage of silicon atom ({Si/(C+O+Si)}×100)≤30.0 atm %, the percentage of atomic silicon being determined from total amounts of atomic carbon, oxygen, and silicon present on the topmost surface of the silica-polymer composite nanoparticle and within 3 nm inwards from the topmost surface, the percentages of the atoms being determined with an X-ray photoelectron spectrometer The percentage of atomic silicon present on the surface of the silica-polymer composite nanoparticle is determined by the following procedure.

Determination of Percentage of Silicon Atom

In the silica-polymer composite nanoparticles, the percentage of atomic silicon present on the surface of the silica-polymer composite nanoparticle is determined as follows: Amounts of atomic silicon, atomic carbon, and atomic oxygen are determined by quantitative analysis with an X-ray photoelectron spectrometer "K-Alpha" (available from Thermo Fisher Scientific Inc.) under the following conditions. From the peak areas of silicon, carbon, and oxygen, the amounts of the respective elements on the surface of the silica-polymer composite nanoparticle and within 3 nm inwards from the surface of the silica-polymer composite nanoparticle are calculated with relative sensitivity factors.

Conditions on Measurement

X-ray: monochromatic Al X-ray source
Acceleration: 12 kV, 6 mA
Resolution: 50 eV
Beam diameter: 400 μm
pass energy: 50 eV
step size: 0.1 eV At a percentage of atomic silicon of less than 15.0 atm %, the content of silicon is significantly small so that the polishing effect of the silica-polymer composite nanoparticles is not sufficiently demonstrated. At a percentage of more than 30.0 atm %, the polishing effect of the silica-polymer composite nanoparticles is significantly large so that the electrophotographic photoreceptor or the cleaning blade is damaged.

The percentage of atomic silicon determined in the present invention includes silicon atoms contained both in the silica nanoparticle and in the hydrophobic agent. The percentage of atomic silicon can be controlled according to the number average primary particle diameter of the silica nanoparticle, the amount of the silica nanoparticles to be added, the amount of the hydrophobic agent containing a silicon atom to be added, the amount of a copolymerizable monomer, and the amount of a crosslinking agent.

Silica Nanoparticles

The silica nanoparticles preferably used in the silica-polymer composite nanoparticles according to the present invention may be prepared by any known process. Examples of the process of preparing silica nanoparticles include dry processes (also referred to as "gas phase processes"), such as a burning process and an arc process, and also include wet processes, such as a precipitation process, a gel process, and a sol-gel process.

Although silica nanoparticles preferred in the present invention are precipitated silica nanoparticles or colloidal silica nanoparticles, other silica nanoparticles may also be used in the invention. These silica nanoparticles may be prepared by any known process, or may be commercially available products.

The precipitated silica nanoparticles can be prepared by a standard process, often prepared by solidification of an aqueous medium into particles having a desired particle diameter in the presence of a high concentration of salt, an acid, or another solidifying agent. The silica nanoparticles are separated by filtration from other reaction product residues, are washed, are dried, and are classified by a standard process. In the precipitated silica nanoparticles, many primary particles are often integrated into somewhat spherical clusters or agglomerates. Such clusters or agglomerates differ in structure from silica prepared by a burning process (also referred to as "fumed silica") or thermally prepared particles (their primary particles are linearly fused into agglomerates). Examples of commercially available products of precipitated silica include Hi-Sil (registered trademark) available from PPG Industries, Inc. and SIPERNAT (registered trademark) available from Degussa Corporation.

Another examples of usable silica nanoparticles include silica nanoparticles which can be prepared by processes described in U.S. Pat. Nos. 4,755,368 and 6,702,994, and Mueller et al., "Nanoparticle Synthesis at High Production By Flame Spray Pyrolysis," Chemical Engineering Science, 58:1969 (2003).

Colloidal silica nanoparticles are typically in the form of unaggregated, discrete particles (primary particles). The shape is spherical or almost spherical, or may have another shape (typically a shape having an oval, square, or rectangular cross section). The colloidal silica nanoparticles are commercially available, or can be prepared with a starting material by any known process (e.g., silica prepared by a wet process). The colloidal silica nanoparticles are typically prepared by the same process as in precipitated silica nanoparticles (namely, prepared by solidification of an aqueous medium), or are also available in the form of a dispersion in a liquid medium (water alone or water containing a co-solvent and an optional stabilizer). The silica nanoparticles can be prepared with silicic acid derived from an alkali metal silicate solution having a pH of 9 to 11, for example. Silicate anion is polymerized to form discrete silica nanoparticles having a desired average particle diameter in the form of an aqueous dispersion. Typically, a colloidal silica starting material can be used in the form of sol or a colloidal silica dispersion in a suitable solvent (mostly water alone or water containing a co-solvent and an optional stabilizer).

These colloidal silica nanoparticles are found in Stoeber et al., Controlled Growth of Monodisperse Silica Spheres in the Micron Size Range, Journal of Colloid and Interface Science, 26, 1968, pp. 62-69; Akitoshi Yoshida, Silica Nucleation, Polymerization, and Growth Preparation of Monodispersed Sols, in Colloidal Silica Fundamentals and Applications, pp. 47 to 56 (H. E. Bergna & W. O. Roberts, eds., CRC Press: Boca Raton, Fla., 2006); and Iler, R. K., The Chemistry of silica, p. 866 (John Wiley & Sons: New York, 1979), for example.

Examples of readily available colloidal silica products used in the present invention include commercial products, such as SNOWTEX (registered trademark) available from Nissan Chemical Industries, Ltd., LUDOX (registered trademark) available from W.R. Grace & Co., NexSil (registered trademark) and NexSil A (registered trademark) series available from Nyacol Nanotechnologies, Inc., Quartron (registered trademark) available from Fuso Chemical Co., Ltd., and Lavasil (registered trademark) available from Akzo Nobel N.V.

The number average primary particle diameter of the colloidal silica nanoparticles ranges from preferably 5 to 100 nm, more preferably 10 to 70 nm, still more preferably 20 to 50 nm. The silica nanoparticles may be unintegrated (for example, substantially spherical) or slightly integrated. For example, the ratio of the integrated diameter to the number average primary particle diameter is within the range of preferably 1.0 to 3.0:1, more preferably 1.0 to 2.0:1, most preferably 1.0 to 1.5:1. The particle diameter can be determined by dynamic light scattering (DLS). Throughout the specification, the number average primary particle diameter of the silica portion indicates the number average primary particle diameter of the colloidal silica nanoparticles included in the silica-polymer composite nanoparticles.

Hydrophobic Agents

The silica nanoparticles are treated with a first hydrophobic agent. The first hydrophobic agent has a group reactive with hydroxy groups present on the surfaces of the silica nanoparticles and a polymerizable functional group to be converted into a polymer.

Although the degree of hydrophobization of the hydrophobic silica nanoparticles can be determined depending on the type or the amount of hydrophobic agents to be used, the reacted hydroxy groups occupy preferably 15 to 85%, more preferably 50 to 80% of hydroxy groups present on the surfaces of the silica nanoparticles.

The first hydrophobic agent is preferably a compound represented by Formula (1):

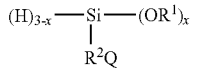

wherein x represents 1, 2, or 3; $R^1$ represents a methyl group or an ethyl group; $R^2$ represents an alkylene group represented by the formula $C_nH_{2n}$ (where n represents an integer of 1 to 10); Q represents a substituted or unsubstituted vinyl, acryloxy (acryloyloxy), or methacryloxy (methacryloyloxy) group.

Examples of the preferred first hydrophobic agents include vinyltriacetoxysilane, (3-acryloxypropyl)trimethoxysilane, (3-acryloxypropyl)triethoxysilane, methacryloxypropyltrimethoxysilane, methacryloxypropyltriethoxysilane, methacryloxymethyltrimethoxysilane, methacryloxymethyltriethoxysilane, (3-acryloxypropyl) methyldimethoxysilane, methacryloxypropylmethyldimethoxysilane, methacryloxypropyldimethylethoxysilane, methacryloxypropyldimethylmethoxysilane, allyltrimethoxysilane, vinyltriethoxysilane, vinyltrimethoxysilane, and vinyltris(2-methoxyethoxy) silane.

The silica nanoparticles can be additionally treated with a second hydrophobic agent before or after the treatment with the first hydrophobic agent or after preparation of the silica-polymer composite nanoparticles. This treatment is performed on only exposed surfaces of the silica nanoparticles. Examples of a preferred second hydrophobic agent include silazane compounds, siloxane compounds, silane compounds, and silicone oil having some solubility in water optionally containing a co-solvent. Suitable for the second hydrophobic agent is a silicone oil having a number average molecular weight of 10000 at most. The second hydrophobic agent can be selected from the group consisting of silazane compounds, siloxane compounds, silane compounds, and silicone oils having a number average molecular weight of 10000 at most. Specific examples of the silane compound include alkylsilanes and alkoxysilanes.

The alkoxysilane is preferably a compound represented by Formula (2):

$$R^3_xSi(OR^4)_{4-x}$$

where $R^3$ represents a $C_1$ to $C_{30}$ branched or linear alkyl or alkenyl group, a $C_3$ to $C_{10}$ cycloalkyl group, or a $C_6$ to $C_{10}$ aryl group; $R^4$ represents a $C_1$ to $C_{10}$ branched or linear alkyl group; x represents an integer of 1 to 3.

If a metal oxide does not contain silica, the second hydrophobic agent is preferably a bi- or trifunctional silane, siloxane, or silicone oil.

Preferred examples of silane compounds usable as the second hydrophobic agent include trimethylsilane, trimethylchlorosilane, dimethyldichlorosilane, methyltrichlorosilane, allyldimethylchlorosilane, benzyldimethylchlorosilane, methyltrimethoxysilane, methyl triethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-butyltrimethoxysilane, n-octyltriethoxysilane, n-hexadecyltrimethoxysilane, and n-octadecyltrimethoxysilane. Preferred examples of siloxane compounds useful in the present invention include octamethylcyclotetrasiloxane and hexamethylcyclotrisiloxane. Preferred examples of silazane compounds useful in the present invention include hexamethyldisilazane (HMDS), hexamethylcyclotrisilazane, and octamethyl cyclotetrasilazane. For example, HMDS can be used to cover unreacted hydroxy groups on the surfaces of the silica nanoparticles. Examples of typical hydrophobic agents include hexamethyldisilazane, isobutyltrimethoxysilane, octyltrimethoxysilane, and cyclic silazane disclosed in U.S. Pat. No. 5,989,768. Such a cyclic silazane is represented by Formula (3):

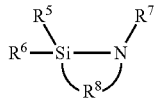

wherein $R^5$ and $R^6$ are each independently selected from the group consisting of a hydrogen atom, a halogen atom, an alkyl group, an alkoxy group, an aryl group, and an aryloxy group; $R^7$ is selected from the group consisting of hydrogen, $(CH_2)_rCH_3$ (where r is an integer of 0 to 3), $C(O)(CH_2)_rCH_3$ (where r is an integer of 0 to 3), $C(O)NH_2$, $C(O)NH(CH_2)_rCH_3$ (where r is an integer of 0 to 3), and $C(O)N[(CH_2)_rCH_3](CH_2)_sCH_3$ (where r and s are each an integer of 0 to 3); $R^8$ is represented by Formula (4):

$$[(CH_2)_a(CHX)_b(CYZ)_c]$$

wherein X, Y, and Z are each independently selected from the group consisting of a hydrogen atom, a halogen atom, an alkyl group, an alkoxy group, an aryl group, and an aryloxy group; a, b, and c each represent an integer of 0 to 6; (a+b+c) represents an integer of 2 to 6.

A cyclic silazane preferably used in the present invention is a 5-membered or 6-membered ring represented by Formula (5):

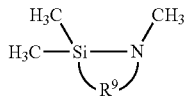

wherein $R^9$ is represented by Formula (6):

$$[(CH_2)_a(CHX)_b(CYZ)_c]$$

wherein X, Y, and Z are each independently selected from a hydrogen atom, a halogen atom, an alkyl group, an alkoxy group, an aryl group, and an aryloxy group; a, b, and c each represent an integer of 0 to 4; (a+b+c) represents an integer of 3 or 4.

The silicone oil suitable for the second hydrophobic agent includes unfunctionalized silicone oil and functionalized silicone oil. Depending on the conditions on the surface treatment of the silica nanoparticles and the type of silicone oil, the silicone oil can be present as a non-covalently bound coating, or can be covalently bound to the surfaces of the silica nanoparticles.

Preferred examples of unfunctionalized silicone oil useful in the present invention include polydimethylsiloxane, polydiethylsiloxane, phenylmethylsiloxane copolymers, fluoroalkylsiloxane copolymers, diphenylsiloxane-dimethylsiloxane copolymers, phenylmethylsiloxane-dimethylsiloxane copolymers, phenylmethylsiloxane-diphenylsiloxane copolymers, methylhydrosiloxane-dimethylsiloxane copolymers, and polyalkylene oxide-modified silicone.

The functionalized silicone oil indicates a silicone oil having a functional group reactive with an organic group at one or both terminals of silicone. The functionalized silicone oil can have a functional group selected from the group consisting of a vinyl group, a hydroxy group, a thiol group, a silanol group, an amino group, and an epoxy group. The functional group can be bound to the main chain of a silicone polymer directly or via an alkyl group, an alkenyl group, or an aryl group.

In the present invention, a dimethylsiloxane copolymer disclosed in U.S. Patent Application Publication No. 2012/798540 filed on Apr. 6, 2010 can be used to treat the silica nanoparticles.

Among typical dimethylsiloxane copolymers, preferred is a copolymer represented by Formula (7):

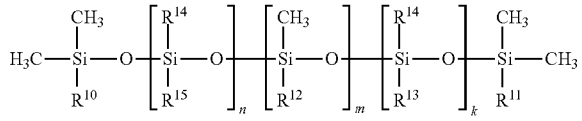

where $R^{10}$ represents a hydrogen atom or a methyl group; $R^{11}$ represents a hydrogen atom or a methyl group; $R^{12}$ represents a methyl group, an ethyl group, an n-propyl group, an aralkyl group (—$CH_2$Ar or —$CH_2CH_2$Ar), an aryl group, —$CH_2CH_2CF_3$, or —$CH_2CH_2$—$R^f$ (where $R^f$ represents a $C_1$ to $C_8$ perfluoroalkyl group); $R^{13}$ represents a methyl group, an ethyl group, an n-propyl group, a trifluoropropyl group, or —$CH_2CH_2$—$R^f$ (where $R^f$ is a $C_1$ to $C_8$ perfluoroalkyl group); $R^{14}$ represents a methyl group, an ethyl group, an aralkyl group (—$CH_2$Ar, —$CH_2CH_2$Ar), or an aryl group; $R^{15}$ represents a hydrogen atom, a hydroxy group, a methoxy group, or an ethoxy group; Ar represents an unsubstituted phenyl group or a phenyl group substituted with one or more methyl groups, halogen atoms, ethyl groups, trifluoromethyl groups, pentafluoroethyl groups, or trifluoroethyl groups. n, m, and k each represent an integer, and $n \geq 1$, $m \geq 1$, and $k \geq 0$. The copolymer preferably has a molecular weight of 200 to 20000.

The second hydrophobic agent may be a charge control agent. A charge modifier disclosed in U.S. Patent Application No. 2010/0009280 can be used. Examples of the charge control agent preferably used in the present invention include, but should not be limited to, 3-(2,4-dinitrophenylamino)propyltriethoxysilane (DNPS), 3,5-dinitrobenzamide-n-propyltriethoxysilane, 3-(triethoxysilylpropyl)-p-nitrobenzamide (TESPNBA), pentafluorophenyltriethoxysilane (PFPTES), and 2-(4-chlorosulfonylphenyl) ethyltrimethoxysilane (CSPES). Charge control agents containing nitro groups are preferably used to post treat the silica nanoparticles after the treatment of the copolymer because hydride groups can reduce the nitro groups.

The silica nanoparticles can be treated with a third hydrophobic agent in addition to the second hydrophobic agent to prepare silica-polymer composite nanoparticles.

The third hydrophobic agent can be alkylhalosilane or a silicone oil having a number average molecular weight of more than 10000.

The alkylhalosilane contains a compound represented by Formula (8):

$$R^3_xSiR^4_yX_{4-x-y}$$

where $R^3$ and $R^4$ are as defined in Formula (2); X represents a halogen atom, preferably a chlorine atom; y represents an integer of 1, 2, or 3; x+y represents 3.

The second hydrophobic agent and the third hydrophobic agent are used after formation of the silica-polymer composite nanoparticles. These hydrophobic agents interact with the polymer component of the silica-polymer composite nanoparticles and can further modify the surfaces of the silica nanoparticles exposed from the silica-polymer composite nanoparticles.

The polymer of the silica-polymer composite nanoparticles may be composed of the same material as the material for the first hydrophobic agent or a different material. Namely, if the first hydrophobic agent has a polymerizable group, the same material for the first hydrophobic agent can be used to prepare the polymer.

In the present invention, besides the first hydrophobic agent having the polymerizable group, a different monomer copolymerizable with a terminal group of the first hydrophobic agent may be used. Examples of a monomer suitably used in the preparation of the silica-polymer composite nanoparticles include substituted or unsubstituted vinyl and acrylate monomers, and other monomers polymerizable by radical polymerization. Typical examples of such monomers include styrene, acrylic acid esters, methacrylic acid esters, olefin, vinyl esters, and acrylonitrile. These monomers are available from Sigma-Aldrich, Inc. (Milwaukee, Wis.), for example. These monomers can be used alone or in the form of a mixture including an optional crosslinking agent to prepare a copolymer.

Preparation of Silica-Polymer Composite Nanoparticles

The silica-polymer composite nanoparticles can be readily prepared by a known process. In one typical process, an aqueous dispersion of the first hydrophobic agent and silica is prepared in a mass ratio of hydrophobic agent:silica of preferably 0.8:1 to 20.0:1, more preferably 1.2:1 to 16.0:1. The pH of the aqueous dispersion is 8.0 to 8.5. The dispersion is stirred at 50 to 60° C. (usually for 1 to 3 hours) to prepare an emulsion. An initiator is then introduced in an amount of 1 to 4 mass % relative to the monomer (the first hydrophobic agent) in the form of an ethanol solution or a solution in a different solvent miscible with water. Examples of suitable initiators include, but should not be limited to, oil-soluble azo and peroxide thermal initiators. Usable examples of such initiators include 2,2'-azobis(2-methylpropionitrile) (AIBN), benzoyl peroxide, tert-butyl peracetate, and cyclohexanone peroxide. These initiators are available from Wako Pure Chemical Industries, Ltd. The initiator is dissolved in the monomer before addition of silica. The solution is kept at 65 to 95° C. for 4 to 6 hours with stirring. The resulting slurry is dried at 100 to 130° C. overnight to prepare a solid. The solid is ground into powder. The second hydrophobic agent may be added after the preparation of the silica-polymer composite nanoparticles and before the drying step. For example, the second hydrophobic agent is added to the slurry, and the slurry is further stirred at 60 to 75° C. for 2 to 4 hours.

The amount of silica exposed from the surfaces of the silica-polymer composite nanoparticles varies over the exposure (contact) time of the silica nanoparticles to the first hydrophobic agent. The silica nanoparticles in the emulsion are adsorbed onto the surfaces of droplets (micelles) containing the first hydrophobic agent.

The silica nanoparticles are hydrophobized through formation of bonds between the first hydrophobic agent and their surfaces to gradually enhance the hydrophobicity of the silica nanoparticles. Such silica nanoparticles having enhanced hydrophobicity move from an aqueous continuous phase into the droplets in the emulsion to reduce the amount of silica exposed from the droplets containing the first hydrophobic agent. After the polymerization, the silica nanoparticles are fixed inside polymer particles prepared by polymerization of the droplets containing the first hydrophobic agent. Silica-polymer composite nanoparticles are prepared.

The second hydrophobic agent can be used to control the degree of hydrophobization of the silica nanoparticles exposed from the surfaces of the silica-polymer composite nanoparticles.

A copolymerizable monomer or a crosslinking agent can be added to the reaction mixture, in addition to the first hydrophobic agent. These monomers may be added to the reaction mixture during or after addition of the first hydrophobic agent. The copolymerizable monomer is copolymerized with the first hydrophobic agent to form the polymer portion of the silica-polymer composite nanoparticles. Such a copolymerizable monomer is suitably used as an additive for a toner. The copolymerizable monomer and the crosslinking agent can be any monomer usable as an additive for a toner. Examples of such a monomer include divinyl-termined hydrophobic agents (e.g., vinyl-substituted silane compounds) used as the first hydrophobic agent. Further examples thereof include known vinyl crosslinking agents, such as divinylbenzene or ethylene glycol dimethacrylate. The amount of the crosslinking agent to be added can be appropriately determined according to the degree of crosslinking of the polymer.

The degree of the surface treatment of the first hydrophobic agent with silica can be controlled by the pH and the temperature of a starting solution. The adsorption rate of the first hydrophobic agent to the silica nanoparticles (rate of forming siloxane bond between the surface of the silica nanoparticles and the hydrophobic agent) can be controlled by selection of the leaving group present on silane. Silane having an ethoxy group hydrolyzes slower than silane having a methoxy group.

The extent of the surface treatment of the silica nanoparticles affects the amount of silica nanoparticles exposed from the surfaces of the silica-polymer composite nanoparticles. A mixture of the first hydrophobic agent and an aqueous solution of silica nanoparticles is agitated to be emulsified. The silica nanoparticles then migrate onto the surfaces of the droplets of the first hydrophobic agent to be stabilized. Silane is hydrolyzed, and is adsorbed onto the surfaces of the silica nanoparticles. This adsorption of silane further increases the original hydrophobicity of the silica nanoparticles, enhancing the miscibility of the silica nanoparticles with an organic phase. Such silica nanoparticles gradually move from the aqueous phase to the organic phase at the interface between the organic phase and the aqueous phase. Accordingly, the amount of silica nanoparticles exposed from the surfaces of the silica-polymer composite nanoparticles can be controlled by the extent of the surface treatment of the silica nanoparticles before polymerization.

Alternatively, the silica-polymer composite nanoparticles can be prepared by processes disclosed in WO 2008/142383 and Schmid et al. (Advanced Materials, 2008, 20, 3331-3336; and Fiejding et al., Langmuir, Jul. 21, 2011, published on line, see DOI 10.1021/1a202066n). Namely, colloidal silica nanoparticles can be surface treated with the first hydrophobic agent having a terminal or other usable hydroxy group by a known method described in WO 2004/035474, for example. A monomer is added to an agitated dispersion of 3.5 to 5 mass % treated silica nanoparticles to prepare a 10% monomer mixture. The monomer mixture is degassed, and is heated to 60° C. Excess water-soluble radical initiator adsorbed onto the surfaces of the silica nanoparticles is dissolved in the monomer mixture to perform polymerization for 24 hours. The mixture is centrifuged at 3000 to 6000 rpm for 30 minutes to remove excess silica nanoparticles and a supernatant.

Alternatively, the silica-polymer composite nanoparticles can be prepared by processes disclosed in Sacanna et al. (Langmuir 2007, 23, 9974-9982 and Langmuir 2007, 23, 10486-10492). Silica nanoparticles are dispersed in a 2M tetramethylammonium hydroxide or ammonium hydroxide, and are re-dispersed in water. The first hydrophobic agent (e.g., 3-methacryloxypropyltrimethoxysilane), and then potassium persulfate is added to the dispersion for polymerization.

The silica-polymer composite nanoparticles typically have spherical shapes. The silica-polymer composite nanoparticles may have any other shape other than the spherical shape, and may have irregular (bumpy) surfaces depending on the degree of exposure of the silica nanoparticles from the silica-polymer composite nanoparticles. The silica-polymer composite nanoparticles have an aspect ratio of preferably 0.80 to 1.15:1, more preferably 0.90 to 1.10:1.

The silica-polymer composite nanoparticles have a number average primary particle diameter of preferably 50 to 500 nm, more preferably 70 to 250 nm. A number average primary particle diameter within this range attains appropriate removal by polishing of excess lubricant applied onto the electrostatic latent image carrier and reduces wear of the electrostatic latent image carrier and the cleaning blade.

Control of Diameter of Silica-Polymer Composite Nanoparticle

The number average primary particle diameter of the silica-polymer composite nanoparticle can be controlled by the particle diameters of the droplets contained in the first hydrophobic agent added to the aqueous dispersion liquid of the raw material silica nanoparticles. For example, the number average primary particle diameter of the silica-polymer composite nanoparticle can be controlled by the intensity of agitation of a mixture of the aqueous dispersion liquid of the silica nanoparticles and the first hydrophobic agent. Alternatively, the number average primary particle diameter of the silica-polymer composite nanoparticle can be controlled by a mass ratio $M_{MON}/M_{silica}$ (where $M_{MON}$ is the mass of the first hydrophobic agent and $M_{silica}$ is the mass of silica) or the particle diameter of colloidal silica.

Determination of Number Average Primary Particle Diameter of Silica-Polymer Composite Nanoparticles The number average primary particle diameter of the silica-polymer composite nanoparticle is determined by the following procedure.

A toner containing the silica-polymer composite nanoparticles is photographed with a scanning electron microscope "JSM-7401F" (available from JEOL, Ltd.) at a magnification of 30000, and the photographed image is taken in with a scanner. Images of oxide particles present on the surface of the toner in the photograph are binarized with an image processing analyzer "LUZEX (registered trademark) AP" (available from NIRECO CORPORATION), and the horizontal Feret diameters of 100 silica-polymer composite nanoparticles are calculated. The average value is defined as the number average primary particle diameter. The horizontal Feret diameter indicates the length of a circumscribing rectangle of a nanoparticle parallel to the x-axis in the binarized image of the external additive (silica-polymer composite nanoparticles).

Toner

The toner used in the process of forming an image according to the present invention comprises at least a toner matrix particle and an external additive nanoparticle, the external additive nanoparticle comprises a silica-polymer composite nanoparticle, and the percentage of atomic silicon present on the surface of the silica-polymer composite nanoparticle satisfies at least Condition A expressed by Expression: 15.0 atm %≤percentage of silicon atom ({Si/(C+O+Si)}×100)≤30.0 atm %, the percentage of atomic silicon being determined from amounts of atomic carbon, oxygen, and silicon present on the topmost surface of the silica-polymer composite nanoparticle and within 3 nm inwards from the topmost surface, the percentages being determined with an X-ray photoelectron spectrometer.

In the present invention, "toner particles" indicates the toner matrix particles containing the external additive. The "toner" indicates a collectivity of the "toner particles."

Description of Toner Matrix Particles

The toner matrix particles contain a binder resin and optional additives, such as a colorant, a mold release agent, and a charge control agent. Usually, the toner matrix particles can be used as toner particles alone. The toner particle used in the present invention is composed of the toner matrix particle containing the silica-polymer composite nanoparticle according to the present invention as an external additive.

Binder Resin

In the toner matrix particle for the toner according to the present invention prepared by dissolution suspension, examples of the binder resin for the toner matrix particle include styrene polymers, acrylic polymers, styrene-acrylic copolymers, polyesters, silicone polymers, olefin polymers, amide polymers, and epoxy polymers.

Among these binder resins, preferred are styrene polymers, acrylic polymers, styrene-acrylic copolymers, and polyesters, which have low viscosity and high sharp melting behaviors. These binder resins can be used alone or in combination.

In the toner matrix particle for the toner according to the present invention prepared by pulverization or suspension polymerization, mini-emulsion polymerization aggregation, or emulsion polymerization aggregation, examples of polymerizable monomers used for preparation of polymers for the toner matrix particles include a variety of known polymerizable monomers, such as vinyl monomers. A polymerizable monomer having an ionically dissociating group is preferably used in combination. The polymerizable monomer can also be a polyfunctional vinyl monomer, which attains a binder resin having a crosslinking structure.

Colorant

The colorant usable in the toner matrix particle according to the present invention can be any known inorganic or organic colorant. Examples of such a colorant include carbon black, magnetic powder, a variety of organic and inorganic pigments and dyes. The colorant is added in an amount of 1 to 30 mass %, preferably 2 to 20 mass % relative to the toner matrix particles.

Mold Release Agent

The toner matrix particles according to the present invention can contain a mold release agent as an additive. A preferred mold release agent is wax. Examples of wax include hydrocarbon waxes, such as low molecular weight polyethylene wax, low molecular weight polypropylene wax, Fischer-Tropsch wax, microcrystalline wax, and paraffin wax; and ester waxes, such as carnauba wax, pentaerythritol behenic acid ester, behenyl behenate, and behenyl citrate. These mold release agents can be used alone or in combination.

A wax having a melting point of 50 to 95° C. is preferably used to attain a toner fixable and releasable at low temperature. The content of the wax is preferably 2 to 20 mass %, more preferably 3 to 18 mass %, most preferably 4 to 15 mass % relative to the total amount of the binder resin.

The wax contained in the toner matrix particles preferably forms domains to attain a mold releasing effect. The wax domain formed in the binder resin readily attains the respective functions.

The diameter of the wax domain ranges preferably from 300 nm to 2 μm. A wax domain having a diameter in this range attains a sufficient mold releasing effect.

Charge Control Agent

The toner matrix particle according to the present invention can contain an optional charge control agent as an additive. A variety of known charge control agents can be used.

Examples of such a charge control agent include a variety of known compounds which can be dispersed in aqueous media. Specific examples thereof include nigrosine dyes, metal salts of naphthene acid or higher fatty acids, alkoxylated amines, quaternary ammonium salts, azo metal complexes, and metal salts or complexes of salicylic acid.

The content of the charge control agent is preferably 0.1 to 10 mass %, more preferably 0.5 to 5 mass % relative to the total amount of the binder resin.

Preparation of Toner Matrix Particles

The toner matrix particles for the toner can be prepared by any process. Examples thereof include processes, such as pulverization, suspension polymerization, emulsion polymerization aggregation, mini-emulsion polymerization aggregation, dissolution suspension, and polyester molecule chain extension. Among these processes, emulsion polymerization aggregation processes are preferably used in the preparation of the toner matrix particles for the toner. Particularly preferred is mini-emulsion polymerization aggregation involving preparation of polymer particles by multi-stage mini-emulsion polymerization and then integration (aggregation and fusion) of the polymer particles.

Specifically, in mini-emulsion polymerization aggregation, a surfactant in an amount less than a critical micelle concentration is dissolved in an aqueous medium, and a mold release agent is dissolved in a polymerizable monomer to prepare a polymerizable monomer solution. The polymerizable monomer solution is added to the aqueous medium to form oil droplets (10 to 1000 nm) under mechanical energy. A dispersion liquid is prepared. An aqueous polymerization initiator is added to the dispersion liquid for radical polymerization and then integration (aggregation and fusion) of the resulting polymer nanoparticles into toner matrix particles. In mini-emulsion polymerization aggregation, an aqueous radical polymerization initiator may be added instead of or in addition to the aqueous polymerization initiator, and an oil-soluble radical polymerization initiator may be added to the monomer solution. The polymer nanoparticles can also have two or more polymer layers having different compositions. In this case, a polymerizable monomer and a polymerization initiator can be added to a dispersion liquid of first polymer particles prepared through a normal mini-emulsion polymerization process (first polymerization), and this system can be polymerized (second polymerization). An additional polymerizable monomer and an additional polymerization initiator can be added, when necessary, for further polymerization (third polymerization) to prepare polymer nanoparticles composed of three layers.

An example process of preparation of toner matrix particles by mini-emulsion polymerization aggregation includes:

(1) a dissolving or dispersing step of dissolving or dispersing materials for toner matrix particles, such as a mold release agent and a charge control agent, when necessary, in a polymerizable monomer (for binder resin) to prepare a polymerizable monomer solution, (2) a polymerization step of converting the polymerizable monomer solution into oil droplets in an aqueous medium and mini-emulsion polymerizing the monomer to prepare an aqueous dispersion liquid of polymer nanoparticles, (3) a step of dispersing a colorant in an aqueous medium to prepare an aqueous dispersion liquid of colorant nanoparticles, (4) an aggregating and fusing step of mixing the aqueous dispersion liquid of the polymer nanoparticles with the aqueous colorant nanoparticle dispersion to prepare aggregated particles by salting-out, aggregation, and fusion of the mixture in the aqueous medium, (5) an aging step of aging the aggregated particles by thermal energy to adjust the shapes of the particles to prepare an aqueous dispersion liquid of toner matrix particles, (6) a cooling step of cooling the aqueous dispersion liquid of the toner matrix particles, (7) a filtering and washing step of separating the toner matrix particles from the cooled aqueous dispersion liquid through filtration, and removing the surfactant from the toner matrix particles, and (8) a drying step of drying the washed toner matrix particles.

Throughout the specification, the "aqueous medium" indicates a medium composed mainly of water (50 mass % or more). Besides water, the aqueous medium can contain an organic solvent miscible with water. Examples thereof include methanol, ethanol, isopropanol, butanol, acetone, methyl ethyl ketone, and tetrahydrofuran. Among these organic solvents, particularly preferred are alcoholic organic solvents, such as methanol, ethanol, isopropanol, and butanol, which do not dissolve polymers.

In the present invention, the aqueous dispersion liquid of the polymer nanoparticles (binder resin) are mixed with the aqueous colorant nanoparticle dispersion, and the toner matrix particles are prepared by aggregation and fusion of the mixture. The toner matrix particles are used to prepare a toner. Shells may be formed on the surfaces of the toner matrix particles functioning as cores to prepare toner matrix particles having a core-shell structure.

In this case, after aging step (5), an aqueous dispersion liquid of polymer nanoparticles for a shell is added to the aqueous dispersion liquid of the toner matrix particles, and the polymer nanoparticles for a shell are aggregated and fused onto the surfaces of the toner matrix particles (core particles) to form toner matrix particles having a core-shell structure.

Furthermore, according to the process described above, the polymer particles can be aggregated and fused using aqueous dispersion liquids of different polymer nanoparticles having different physical properties, such as a glass transition temperature and a softening point, to prepare toner matrix particles having a domain-matrix structure. The toner matrix particles having a domain-matrix structure can be prepared by aggregation and fusion of a mixture of an aqueous dispersion liquid of polymer nanoparticles for a domain, an aqueous dispersion liquid of polymer nanoparticles for a matrix, and an aqueous dispersion liquid of colorant nanoparticles.

Throughout the specification, the domain-matrix structure indicates a structure having a domain phase having a closed interface (boundary between phases) in a continuous matrix phase.

The toner matrix particle according to the present invention preferably has such a domain-matrix structure. Such a toner matrix particles having a domain-matrix structure has a hardness distribution (partially different hardness) on their surfaces. This hardness distribution appropriately adjusts the adhesion to the silica-polymer composite nanoparticles, and also adjusts the amount of the silica-polymer composite nanoparticles detached from the toner matrix particles to function as a polisher.

Toner Matrix Particle Having Domain-Matrix Structure

The toner matrix particle having a domain-matrix structure will now be described in detail.

The toner matrix particle according to the present invention preferably has a domain-matrix structure. The matrix preferably has a vinyl polymer having acid groups. The domain preferably contains a polymer (also referred to as "styrene-acrylic modified polyester") composed of a styrene-acrylic polymer segment and a polyester polymer segment combined therewith. The toner matrix particles having a domain-matrix structure can be prepared by mini-emulsion polymerization aggregation. The configurations of the respective polymers and then the configuration of the toner matrix particle will now be described.

Polymer for Matrix

The polymer for a matrix preferably contains a vinyl polymer having acid groups. A preferred polymer for a matrix is a non-crystalline polymer containing a vinyl polymer having acid groups. The vinyl polymer having acid groups at least contains a polymer prepared by polymerization of a monomer having an acid group.

Monomer Having Acid Groups

Throughout the specification, the acid group indicates an ionically dissociating group, such as a carboxy group, a sulfonate group, and a phosphate group. Examples of a monomer having a carboxy group as an acid group include acrylic acid, methacrylic acid, maleic acid, itaconic acid, cinnamic acid, fumaric acid, maleic acid monoalkyl ester, and itaconic acid monoalkyl ester. Examples of a monomer having a sulfonate group include styrenesulfonic acid, allylsulfosuccinic acid, and 2-acrylamide-2-methylpropanesulfonic acid. Examples of a monomer having a phosphate group include acidophosphooxyethyl methacrylate.

Among these monomers, preferred are acrylic acid and methacrylic acid in view of the surface polarity of a latex prepared by emulsion polymerization in an aqueous medium.

In the present invention, a vinyl polymer having acid groups can have a polarity higher than that of the styrene-acrylic modified polyester in the domain. Probably due to such a difference in polarity, the styrene-acrylic modified polyester having a low polarity can be readily disposed inside of the toner particles during the preparation of the toner matrix particles in the aqueous medium, attaining a toner having heat resistance during storage and fixing at low temperature.

Acrylic Acid Ester Monomer

The vinyl polymer having acid groups according to the present invention preferably contains a polymer prepared by polymerization of an acrylic acid ester monomer in addition to the monomer having an acid group.

Examples of such acrylic acid ester monomers include methyl acrylate, ethyl acrylate, isopropyl acrylate, n-butyl acrylate, t-butyl acrylate, isobutyl acrylate, n-octyl acrylate, and 2-ethylhexyl acrylate.

Other Vinyl Monomers

The vinyl polymer having acid groups may be prepared with vinyl monomers other than the monomer having acid groups and the acrylic acid ester monomers listed above. Examples thereof include styrenic monomers, such as styrene, o-methylstyrene, m-methylstyrene, p-methylstyrene, p-methoxystyrene, p-phenylstyrene, p-chlorostyrene, p-ethylstyrene, p-n-butyl styrene, p-tert-butylstyrene, p-n-hexylstyrene, p-n-octylstyrene, p-n-nonylstyrene, p-n-decylstyrene, p-n-dodecylstyrene, 2,4-dimethylstyrene, 3,4-dichlorostyrene; methacrylic esters, such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate; olefins such as ethylene, propylene, and isobutylene; and acrylic or methacrylic acid derivatives, such as acrylonitrile, methacrylonitrile, and acrylamide.

These vinyl monomers can be used alone or in combination.

The content of the monomer having acid groups used in preparation of the vinyl polymer having acid groups is preferably 4 to 10 mass %. A content within this range can attain a vinyl polymer having an appropriate polarity, which has no compatibility with the styrene-acrylic modified polyester. The phases of these polymers can be separated from each other to form a domain-matrix structure. A toner having favorable fixing characteristics at low temperature is also attained.

Polymerization of Vinyl Polymer Having Acid Groups

The vinyl polymer having acid groups can be polymerized by a standard polymerization process. In the present invention, emulsion polymerization is preferred.

Polymerization Initiator

A variety of known polymerization initiators are suitably used in the step of polymerizing the vinyl polymer having acid groups. Specific examples thereof include peroxides, such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethyl benzoyl peroxide, lauroyl peroxide, ammonium persulfate, sodium persulfate, potassium persulfate, diisopropylperoxycarbonate, tetralin hydroperoxide, 1-phenyl-2-methylpropyl-1-hydroperoxide, pertriphenylacetic acid-tert-hydroperoxide, tert-butyl performate, tert-butyl peracetate, tert-butyl perbenzoate, tert-butyl perphenylacetate, tert-butyl permethoxyacetate, and tert-butyl per-N-(3-tolyl)palmitate; and azo compounds, such as 2,2'-azobis(2-aminodipropane)hydrochloric acid salts, 2,2'-azobis-(2-aminodipropane)nitric acid salts, 1,1'-azobis(sodium 1-methylbutyronitrile-3-sulfonate), 4,4'-azobis-4-cyanovaleric acid, and poly(tetraethylene glycol-2,2'-azobisisobutyrate).

Chain Transfer Agent

In the step of polymerizing a vinyl polymer having acid groups, a typical chain transfer agent can be used to control the molecular weight of the vinyl polymer. Examples of the chain transfer agent include, but should not be limited to, alkyl mercaptan and mercapto-fatty acid esters. The chain transfer agent is preferably mixed with other polymer forming materials in a mixing step.

Weight Average Molecular Weight

The weight average molecular weight (Mw) of the vinyl polymer having acid groups ranges from preferably 7500 to 100000, more preferably 10000 to 50000. A weight average molecular weight (Mw) within the range attains sufficient heat resistance during storage. A weight average molecular weight (Mw) within the range also attains sufficient off-set resistance at high temperature.

Determination of Weight Average Molecular Weight (Mw)

The weight average molecular weight of the vinyl polymer having acid groups is determined with a gel permeation chromatograph (GPC).

Namely, a sample is dissolved in tetrahydrofuran in a concentration of 1 mg/mL. The sample is dissolved with an ultrasonic dispersing machine at room temperature for 5 minutes. The solution is filtered through a membrane filter having a pore size of 0.2 μm, and the resulting sample solution (10 μL) is injected into the GPC.

Operation Conditions

GPC: HLC-8220 (available from Tosoh Corporation)

Columns: three columns of TSKguard column+TSKgel SuperHZM-M (available from Tosoh Corporation)

Column temperature: 40° C.

Solvent: tetrahydrofuran

Flow rate: 0.2 mL/min

Detector: refractive index detector (RI detector)

In the measurement of the molecular weight of the sample, the molecular weight distribution of the sample is calculated with a calibration curve produced from the measurement of ten monodispersed polystyrene standard samples.

Glass Transition Temperature (Tg)

The vinyl polymer having acid groups preferably has a glass transition temperature (Tg) of 35 to 70° C. A glass transition temperature within this range attains sufficient heat resistance during storage.

Determination of Glass Transition Temperature (Tg)

The glass transition temperature (Tg) of the vinyl polymer having acid groups according to the present invention can be determined with a differential scanning calorimeter "Diamond DSC" (available from PerkinElmer Inc.).

The glass transition temperature (Tg) is determined as follows: A polymer (4.5 to 5.0 mg) is precisely weighed to two decimal places, and is sealed in an aluminum pan (KITNO.0219-0041). The aluminum pan is placed in a sample holder. An empty aluminum pan is used as a reference. In the measurement, the temperature is controlled from 0 to 200° C. through a series of operation of first heating, cooling, and then second heating at a heating rate of 10° C./min and a cooling rate of 10° C./min. The data on the second heating is analyzed.

The glass transition temperature is defined as the point of intersection of the extrapolated line of the baseline before the rise of a first endothermic peak and a tangent indicating the largest incline from the rise of the first peak to the peak vertex.

Polymer for Domain

The polymer for a domain preferably contains a polymer composed of a styrene-acrylic polymer segment and a polyester polymer segment combined with the styrene-acrylic polymer segment. Such a polymer (styrene-acrylic modified polyester) is preferably composed of a styrene-acrylic polymer segment combined with a polyester polymer segment via a bireactive monomer described later. The polyester polymer segment may be crystalline polyester or may be non-crystalline polyester, preferably crystalline polyester. The domain composed of the styrene-acrylic modified polyester may contain wax.

The content of the styrene-acrylic modified polyester in the toner matrix particles is preferably within the range of 3 to 30 mass %. At a content within this range, the phase of the vinyl polymer having acid groups (for matrix) is separated from the phase of the styrene-acrylic modified polyester (for domain) to form a preferred domain-matrix structure, which attains high heat resistance during storage and sufficient fixing characteristics at low temperature.

Throughout the specification, the term "crystallinity" of the "crystalline polymer" indicates a polymer having a clear endothermic peak, not a mere endothermic change, in a thermograph by differential scanning calorimetry (DSC). The clear endothermic peak has a half width within the range of 15° C. or less, which is determined at a heating rate of 10° C./min by differential scanning calorimetry (DSC).

The crystalline styrene-acrylic modified polyester has a melting point of preferably 50 to 95° C., more preferably 55 to 85° C.

A styrene-acrylic modified polyester having a melting point within this range attains sufficient heat resistance during storage and fixing characteristics at low temperature, and high hot offset resistance.

The melting point of the styrene-acrylic modified polyester can be controlled mainly by the monomer composition of the polyester polymer segment.

Throughout the specification, the melting point of the styrene-acrylic modified polyester indicates a value determined by the following procedure.

The melting point is determined with a differential scanning calorimeter "Diamond DSC" (available from PerkinElmer Inc.) through a first heating step at a heating rate of 10° C./min from 0° C. to 200° C., a cooling step at a cooling rate of 10° C./min from 200° C. to 0° C., and then a second heating step at a heating rate of 10° C./min from 0° C. to 200° C. Based on the DSC curve produced from this operation, the endothermic peak temperature of the crystalline polyester derived from the first heating step is defined as the melting point. In the measurement, a sample (3.0 mg) is sealed in an aluminum pan, and the aluminum pan is placed in the sample holder of Diamond DSC. An empty aluminum pan is used as a reference.

The weight average molecular weight (Mw) of the styrene-acrylic modified polyester determined by gel permeation chromatography (GPC) is preferably 5000 to 70000.

Styrene-Acrylic Polymer Segment

The styrene-acrylic polymer segment included in the styrene-acrylic modified polyester preferably contains a polymer prepared by copolymerization of an acrylic monomer and an aromatic vinyl monomer, and preferably contains a segment prepared by polymerization of an acrylic acid ester monomer as an acrylic monomer.

Specific examples of the acrylic acid ester monomer include methyl acrylate, ethyl acrylate, isopropyl acrylate, n-butyl acrylate, t-butyl acrylate, isobutyl acrylate, n-octyl acrylate, and 2-ethylhexyl acrylate. These acrylic acid ester monomers can be used alone or in combination.

The styrene-acrylic polymer segment included in the styrene-acrylic modified polyester preferably contains a polymer segment prepared by polymerization of an acrylic acid ester monomer. Such a polymer segment contained in the styrene-acrylic modified polyester has a composition closer to that of the vinyl polymer having acid groups to enhance the affinity between them.

The content of the styrene-acrylic polymer segment in the styrene-acrylic modified polyester is preferably within the range of 5 to 30 mass %. A content within this range attains a preferred domain-matrix structure, and enhances the strength of toner images because of polymer chains appropriately entangled at the interface between the vinyl polymer having acid groups and the styrene-acrylic modified polyester.

The styrene-acrylic polymer segment included in the styrene-acrylic modified polyester is a copolymer prepared with the acrylic acid ester monomer and an aromatic vinyl monomer.

Examples of the aromatic vinyl monomer include styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexyl styrene, p-n-octylstyrene, p-n-nonylstyrene, p-n-decylstyrene, p-n-dodecylstyrene, 2,4-dimethylstyrene, and 3,4-dichlorostyrene and derivatives thereof.

These aromatic vinyl monomers can be used alone or in combination.

Polymerization Initiator

The same polymerization initiator used in polymerization of the vinyl polymer having acid groups can be used in polymerization of the vinyl polymer segment included in the styrene-acrylic modified polyester.

Chain Transfer Agent

In polymerization of the vinyl polymer segment included in the styrene-acrylic modified polyester, a chain transfer agent can be used to control the molecular weight of the vinyl polymer segment. The same chain transfer agent used in polymerization of the vinyl polymer segment having acid groups can be used.

Weight Average Molecular Weight

The vinyl polymer segment included in the styrene-acrylic modified polyester preferably has a weight average molecular weight ranging from 1000 to 20000. A weight average molecular weight within this range readily attains a preferred domain-matrix structure.

Polyester Polymer Segment

The polyester polymer segment included in the styrene-acrylic modified polyester according to the present invention is preferably composed of a crystalline polyester prepared by polycondensation reaction of a polyvalent carboxylic acid compound and polyhydric alcohol in the presence of a catalyst.

A polymer segment composed of such a crystalline polyester preferably has a melting point of 60 to 90° C., and preferably has a weight average molecular weight (Mw) of 2000 to 40000. The crystalline polymer preferably has a melting point and a weight average molecular weight within these ranges.

Polyvalent Carboxylic Acid Compound

The polyvalent carboxylic acid compound used in preparation of the polyester polymer segment has two or more carboxy groups in the molecule. Usable examples of such a polyvalent carboxylic acid compound include alkyl esters, acid anhydrides, and acid chlorides of polyvalent carboxylic acid.

The polyvalent carboxylic acid compound may be a combination with a carboxylic acid selected from divalent carboxylic acids, such as oxalic acid, succinic acid, maleic acid, adipic acid, β-methyladipic acid, azelaic acid, sebacic acid, nonanedicarboxylic acid, decanedicarboxylic acid, undecanedicarboxylic acid, dodecanedicarboxylic acid, fumaric acid, citraconic acid, diglycolic acid, cyclohexane-3,5-diene-1,2-dicarboxylic acid, malic acid, citric acid, hexahydroterephthalic acid, malonic acid, pimelic acid, tartaric acid, furoic acid, phthalic acid, isophthalic acid, terephthalic acid, tetrachlorophthalic acid, chlorophthalic acid, nitrophthalic acid, p-carboxyphenylacetic acid, p-phenylene diacetate, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, and dodecenylsuccinic acid; and tri- or higher-valent carboxylic acids, such as trimellitic acid, pyromellitic acid, naphthalene tricarboxylic acid, naphthalene tetracarboxylic acid, pyrenetricarboxylic acid, and pyrenetetracarboxylic acid. In the present invention, the polyvalent carboxylic acid used in preparation of the crystalline polyester is preferably aliphatic polyvalent carboxylic acid.

Polyhydric Alcohol

The polyhydric alcohol has two or more hydroxy groups in the molecule. Examples of such polyhydric alcohol include divalent alcohols, such as ethylene glycol, propylene glycol, butanediol, diethylene glycol, hexanediol, cyclohexanediol, octanediol, decanediol, dodecanediol, ethylene oxide adducts of bisphenol A, and propylene oxide adducts of bisphenol A; and tri- or higher-hydric polyols, such as glycerol, pentaerythritol, hexamethylolmelamine, hexaethylolmelmelamine, tetramethylolbenzoguanamine, and tetraethylolmelbenzoguanamine. In the present invention, the polyhydric alcohol used in preparation of the crystalline polyester is preferably aliphatic polyhydric alcohol.

Bireactive Monomer

Throughout the specification, the bireactive monomer indicates a monomer which combines the polyester polymer segment with the vinyl polymer segment, and has both a group selected from the group consisting of a hydroxy group, a carboxy group, an epoxy group, a primary amino group, and a secondary amino group, which can bind to the polyester polymer segment, and an ethylenically unsaturated group which can bind to the vinyl polymer segment in the molecule. The bireactive monomer preferably has both a hydroxy or carboxy group and an ethylenically unsaturated group. More preferably, the bireactive monomer has both a carboxy group and an ethylenically unsaturated group. Namely, vinylcarboxylic acid is preferred.

Specific examples of the bireactive monomer include acrylic acid, methacrylic acid, fumaric acid, and maleic acid. The bireactive monomer may be an ester of hydroxyalkyl (having 1 to 3 carbon atoms) acrylic acid, methacrylic acid, fumaric acid, and maleic acid. Preferred are acrylic acid, methacrylic acid and fumaric acid in view of reactivity. The polyester polymer segment is combined with the vinyl polymer segment via the bireactive monomer.

The content of the bireactive monomer is preferably 1 to 10 parts by mass, more preferably 4 to 8 parts by mass relative to the total amount (100 parts by mass) of the vinyl monomer to attain a toner having higher fixing characteristics at low temperature, off-set resistance at high temperature, and durability.

Preparation of Styrene-Acrylic Modified Polyester

The styrene-acrylic modified polyester can be prepared by an existing standard scheme. Typical examples of the process include:

(1) preliminarily polymerizing a polyester polymer segment, reacting the polyester polymer segment with a bireactive monomer, reacting the resultant with an aromatic vinyl monomer and a(n) (meth)acrylate ester monomer for forming a styrene-acrylic polymer segment to prepare a styrene-acrylic modified polyester;

(2) preliminarily polymerizing a styrene-acrylic polymer segment, reacting the styrene-acrylic polymer segment with a bireactive monomer, reacting the resultant with a polyvalent carboxylic acid compound and polyhydric alcohol for forming a polyester polymer segment to prepare a styrene-acrylic modified polyester; and (3) preliminarily polymerizing a polyester polymer segment and a styrene-acrylic polymer segment separately, and reacting these segments with a bireactive monomer to combine these segments.

In the present invention, any one of these processes can be used. Preferred is Process (2): preliminarily polymerizing a styrene-acrylic polymer segment, reacting the styrene-acrylic polymer segment with a bireactive monomer, reacting the resultant with a polyvalent carboxylic acid compound and polyhydric alcohol for forming a polyester polymer segment to prepare polyester.

Specifically, a polyvalent carboxylic acid compound and polyhydric alcohol (for forming a polyester polymer segment) are mixed with a vinyl monomer and a bireactive monomer (for forming a styrene-acrylic polymer segment). A polymerization initiator is added, and the vinyl monomer and the bireactive monomer are subjected to addition polymerization to prepare a styrene-acrylic polymer segment. An esterifying catalyst is added, and a polycondensation reaction is performed.

In the polycondensation reaction of the polyester polymer segment, the equivalent ratio [OH]/[COOH] of the hydroxy group [OH] of the polyhydric alcohol compound to the carboxy group [COOH] of the polyvalent carboxylic acid is preferably 1.5/1 to 1/1.5, more preferably 1.2/1 to 1/1.2.

Catalyst

A variety of known catalysts can be used in preparation of the polyester polymer segment.

Examples of esterifying catalysts include tin compounds, such as dibutyltin oxide and tin(II) 2-ethylhexanoate; and titanium compounds, such as titanium di(isopropoxy)-bis (triethanolaminato). Examples of esterification cocatalysts include gallic acid. The esterifying catalyst is used in an amount of preferably 0.01 to 1.5 parts by mass, more preferably 0.1 to 1.0 part by mass relative to the total amount (100 parts by mass) of the polyhydric alcohol, the polyvalent carboxylic acid compound, and the bireactive monomer component. The esterifying cocatalyst is used in an amount of preferably 0.001 to 0.5 parts by mass, more preferably 0.01 to 0.1 parts by mass relative to the total amount (100 parts by mass) of the polyhydric alcohol, the polyvalent carboxylic acid compound, and the bireactive monomer component.

Preparation of Toner Matrix Particles Having Domain-Matrix Structure

Toner matrix particles having a domain-matrix structure can be prepared as follows: an "aqueous dispersion of a vinyl polymer having acid groups," an "aqueous dispersion of a styrene-acrylic modified polyester nanoparticles," and an "aqueous dispersion of colorant nanoparticles" are aggregated, and fused.

Preparation of Aqueous Dispersion of Vinyl Polymer Nanoparticles Having Acid Groups An aqueous dispersion of the vinyl polymer having acid groups is preferably prepared by emulsion polymerization or mini-emulsion polymerization as described above.

The vinyl polymer having acid groups included in the toner matrix particles is polymerized to prepare polymer nanoparticles. The polymer nanoparticle may have a single-layer configuration, or may have a configuration of two or three layers composed of different polymers having different compositions.

A toner matrix particle having such a configuration allows free selection of the physical properties of the polymers forming the respective layers, such as the weight average molecular weights and the glass transition temperatures of the polymers, enabling control of the properties of the toner matrix particles according to the purpose.

In polymerization of the vinyl polymer having acid groups, the following surfactants can be used, for example. Usable polymerization initiators and chain transfer agents are as listed above.

Surfactant

A dispersion stabilizer is preferably added to an aqueous medium to prevent agglomeration of dispersed nanoparticles.

Examples of usable dispersion stabilizers include a variety of known cationic surfactants, anionic surfactants, and nonionic surfactants.

Specific examples of the cationic surfactant include dodecylammonium bromide, dodecyltrimethylammonium bromide, dodecylpyridinium chloride, dodecylpyridinium bromide, and hexadecyltrimethylammonium bromide.

Specific examples of the nonionic surfactant include dodecylpolyoxyethylene ether, hexadecylpolyoxyethylene ether, nonylphenyl polyoxyethylene ether, lauryl polyoxyethylene ether, sorbitan monooleate polyoxyethylene ether, styrylphenylpolyoxyethylene ether, and monodecanoyl sucrose.

Specific examples of the anionic surfactant include aliphatic soaps, such as sodium stearate and sodium laurate, sodium lauryl sulfate, sodium dodecylbenzenesulfonate, and sodium polyoxyethylene(2) lauryl ether sulfate.

These surfactants can be used alone or in combination.

The polymer nanoparticles prepared with the binder resin in the polymerization step preferably have an average particle size within the range of 50 to 500 nm, which is given as a volume median diameter.

The volume median diameter can be determined with a particle diameter distribution analyzer "UPA-150" (available from MicrotracBEL Corp.).

Preparation of Aqueous Dispersion of Styrene-Acrylic Modified Polyester Nanoparticles Examples of preparation of a dispersion of styrene-acrylic modified polyester nanoparticles include mechanical pulverization of styrene-acrylic modified polyester and then dispersion of the product in an aqueous medium with a surfactant; dissolution of styrene-acrylic modified polyester in an organic solvent and then addition of the solution to an aqueous medium to prepare an aqueous medium dispersion; mixing of melt styrene-acrylic modified polyester with an aqueous medium and then mechanical dispersion of the styrene-acrylic modified polyester to prepare an aqueous medium dispersion; and phase inversion emulsion. The present invention can accept any one of these processes.

The surfactants as listed above can be used.

In the resulting aqueous dispersion of styrene-acrylic modified polyester nanoparticles, the styrene-acrylic modified polyester nanoparticles preferably have an average particle size within the range of 80 to 250 nm, which is given as a volume median diameter.

The volume median diameter is determined with a particle diameter distribution analyzer "UPA-150" (available from MicrotracBEL Corp.).

Preparation of Aqueous Dispersion of Colorant Nanoparticles

A dispersion of colorant nanoparticles can be prepared by dispersion of a colorant in an aqueous medium. For homogenous dispersion of the colorant, the colorant is preferably dispersed in an aqueous medium with a surfactant having a critical micelle concentration (CMC) or more. The colorant can be dispersed with any known dispersing machine.

In the dispersion of colorant nanoparticles thus prepared, the colorant nanoparticles preferably have a volume median diameter of 10 to 300 nm.

The volume median diameter of the colorant nanoparticles in the dispersion is determined with an electrophoretic light scattering photometer ELS-800 (available form Otsuka Electronics Co., Ltd.

The same surfactants as those listed in the preparation of the aqueous dispersion of polymer nanoparticles can be used in the preparation of the dispersion of colorant nanoparticles.

Preparation of Toner Matrix Particles (Aggregation, Fusion)

The toner matrix particles having a domain-matrix structure can be prepared as follows: The aqueous dispersion of nanoparticle of the vinyl polymer having acid groups as a polymer for a matrix is mixed with the aqueous dispersion of styrene-acrylic modified polyester nanoparticles as a polymer for a domain and the aqueous dispersion of colorant nanoparticles, and these are aggregated and fused.

The toner matrix particles according to the present invention can contain internal additives, such as wax and a charge control agent. Such internal additives can be introduced into the toner particles as follows: A dispersion of internal additive nanoparticles composed of only one or more internal additives is prepared, and the internal additive nanoparticles, the polymer nanoparticles, and the colorant nanoparticles are aggregated in the step of preparing toner matrix particles. Preferred is a preliminary introduction of the internal additives in the step of polymerizing a binder resin.

Diameter of Toner Matrix Particles

The toner matrix particles, which are included in the toner particles used in the process of forming an image according to the present invention, preferably have a number average particle diameter of 3 to 8 μm. In the toner matrix particles prepared by polymerization, the particle diameter can be controlled by the concentration of a flocculant, the volume of the organic solvent to be added, the fusing time, and the compositions of the polymers in the process of preparing a toner described above. A number average particle diameter of 3 to 8 μm can attain the reproductivity of thin lines and higher quality of photographic images, and can reduce the consumption of the toner more significantly compared to toners having a larger particle diameter.

Determination of Diameter of Toner Matrix Particles

The volume median diameter ($D_{50}$) of the toner matrix particles can be measured and calculated with a particle size analyzer "Multisizer 3" (available from Beckman Coulter, Inc.) connected to a computer system for data processing, for example. Toner matrix particles (0.02 g) are mixed with a surfactant solution (20 mL) (e.g., a surfactant solution prepared by diluting a neutral detergent containing a surfactant component with ten parts of pure water for dispersion of the toner matrix particles), and ultrasonically dispersed for one minute to prepare a dispersion of toner matrix particles. The dispersion of toner matrix particles is injected into a beaker containing ISOTON II (available from Beckman Coulter, Inc.) held on a sample stand with a pipette until the concentration reaches 5 to 10%. The count of Multisizer 3 is set at 25000, and the sample is measured. The aperture used in Multisizer 3 has a diameter of 100 μm.

The range for measurement of 1 to 30 μm is divided into 256 intervals, and the frequency in each interval is calculated. The particle diameter corresponding to the center of the volume integration is defined as a volume median diameter ($D_{50}$).

Determination of Average Circularity of Toner Matrix Particles

The toner matrix particles, which are included in the toner particles used in the process of forming an image according to the present invention, preferably have an average circularity ranging from 0.850 to 0.990. The average circularity of the toner matrix particles is determined with a dynamic flow particle imaging analyzer "FPIA-2100" (available from Sysmex Corporation). Specifically, the toner matrix particles are wet in a surfactant aqueous solution, and are ultrasonically dispersed for one minute. The dispersion is subjected to measurement with "FPIA-2100" in a high power field (HPF) mode at a proper density in the range of 3000 to 10000. The density within this range can provide high reproducibility of the results. The circularity is calculated by Equation (1):

Circularity=(perimeter of circle having the same area as projected area of particle)/(perimeter of projected image of particle)

The circularities of particles are added, and the sum is divided by the total number of measured particles to determine an arithmetic average, which is defined as the average circularity.

The particle diameter and the average circularity of the toner particles can be determined as in those of the toner matrix particles.

Preparation of Toner Particles

Amount of Silica-Polymer Composite Nanoparticles to be Added

The silica-polymer composite nanoparticles, as an external additive, of the present invention are preferably compounded in an amount of 0.3 to 5.0 parts by mass in 100 parts by mass of the toner matrix particles. An amount within this range attains a toner having preferred charging properties and fluidity, and can enhance resistance to wear of the electrophotographic photoreceptor and the cleaning blade.

Further External Additive Nanoparticles

The toner used in the process of forming an image according to the present invention contains not only the specific external additive nanoparticles (silica-polymer composite nanoparticles) described above, but also further external additive nanoparticles in combination. In use of such further external additive nanoparticles, the entire external additive nanoparticles are preferably added in an amount of 0.1 to 10 parts by mass relative to 100 parts by mass of the toner matrix particles. More preferably, the content of the specific external additive nanoparticles is 0.3 to 5.0 parts by mass relative to the entire external additive nanoparticles.

Examples of the further external additive nanoparticles include a variety of inorganic nanoparticles, organic nanoparticles, and lubricants. Examples of preferred inorganic nanoparticles include nanoparticles of inorganic oxides, such as silica, titania, and alumina. These inorganic nanoparticles are more preferably hydrophobized with a silane coupling agent or a titanium coupling agent. Spherical organic nanoparticles having a number average primary particle diameter of about 10 to 2000 nm can also be used. These organic nanoparticles can be composed of a polymer, such as polystyrene, poly(methyl methacrylate), and styrene-methyl methacrylate copolymer. These further external additive nanoparticles can be used in combination. In combined use, the silica-polymer composite nanoparticles according to the present invention also function as a spacer to prevent further external additive nanoparticles of silica or titania from being buried into the toner matrix particles during stirring of the toner particles in the developing unit.

Application of External Additive Nanoparticles

The external additive nanoparticles comprising such silica-polymer composite nanoparticles are mixed with the toner matrix particles to prepare a toner. The external additive nanoparticles can be applied to the toner matrix particles with a mechanical mixer, such as a Henschel mixer and a coffee mill.

Developer

The toner used in the process of forming an image according to the present invention can be used as a magnetic or non-magnetic one-component developer. The toner can also be used as a two-component developer in the form of a mixture with any known carrier. The toner is mixed with the carrier in an amount of preferably 3 to 15 parts by mass, more preferably 4 to 10 parts by mass relative to 100 parts by mass of the carrier.

The volume average particle diameter of the carrier is preferably 20 to 100 μm, more preferably 25 to 80 μm. The volume average particle diameter of the carrier can be typically determined with a laser diffraction particle diameter distribution analyzer "HELOS" (available from SYMPATEC GmbH) equipped with a wet dispersing machine.

Lubricant

A lubricant applied with a lubricant applicator used in the process of forming an image according to the present invention is preferably a fatty acid metal salt having a Mohs hardness of 2 or less for extension of the lubricant onto the electrostatic latent image carrier. Such fatty acid metal salt is preferably a salt of a metal selected from the group consisting of zinc, calcium, magnesium, aluminum, and lithium. Among these metal salts, particularly preferred are zinc, calcium, lithium, and magnesium salts of fatty acids. Preferred fatty acids for the fatty acid metal salts are higher fatty acids having 12 to 22 carbon atoms. Fatty acid having 12 or more carbon atoms can prevent generation of free fatty acid. Fatty acid having 22 or less carbon atoms can prevent a significant increase in the melting point of fatty acid metal salt, attaining preferred fixing characteristics. Particularly preferred fatty acid is stearic acid. Preferred fatty acid metal salts used in the present invention are zinc stearate, calcium stearate, lithium stearate, and magnesium stearate. These fatty acid metal salts can be used in combination.

Process of Forming an Image

The process of forming an image according to the present invention comprises at least the steps of: developing an electrostatic latent image with a toner, the latent image being formed through charge of the surface of an electrostatic latent image carrier and exposure of the surface to light; and applying a lubricant onto the surface of the electrostatic latent image carrier. The toner comprises at least a toner matrix particle and an external additive nanoparticle, and the external additive nanoparticle comprises a silica-polymer composite nanoparticle. The percentage of atomic silicon present on the surface of the silica-polymer composite fine nanoparticle satisfies at least Condition A expressed by Expression: 15.0 atm %≤percentage of silicon atom ({Si/(C+O+Si)}×100)≤30.0 atm %, the percentage of atomic silicon being determined from total amounts of atomic carbon, oxygen, and silicon present on the topmost surface of the silica-polymer composite fine nanoparticle and within 3 nm inwards from the topmost surface, the percentages of the atoms being determined with an X-ray photoelectron spectrometer.

Figure 2:
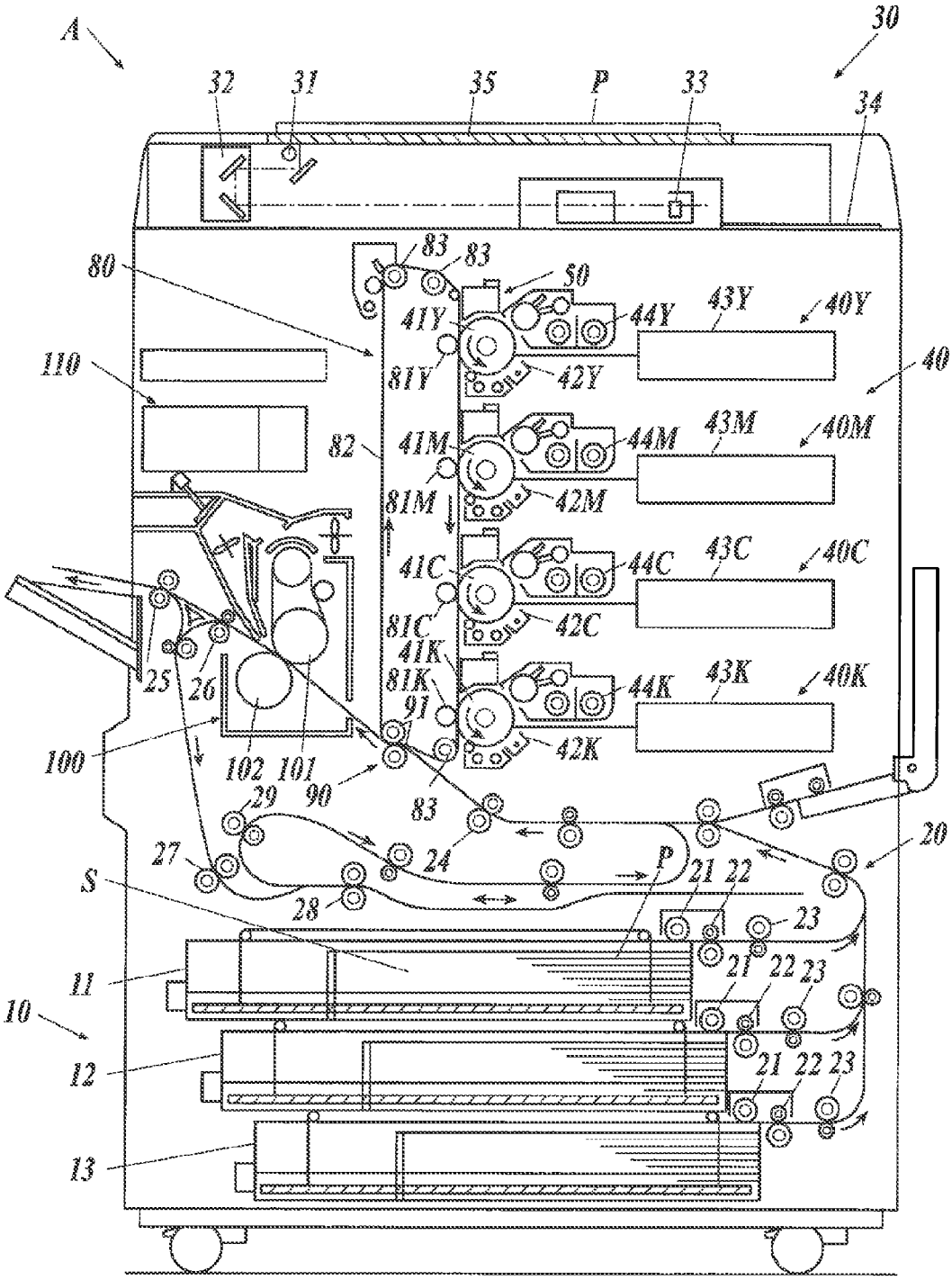
FIG. 2 is a schematic view illustrating an exemplary configuration of an imaging apparatus to which a process of forming an image according to the present invention is applied.
Figure 3:
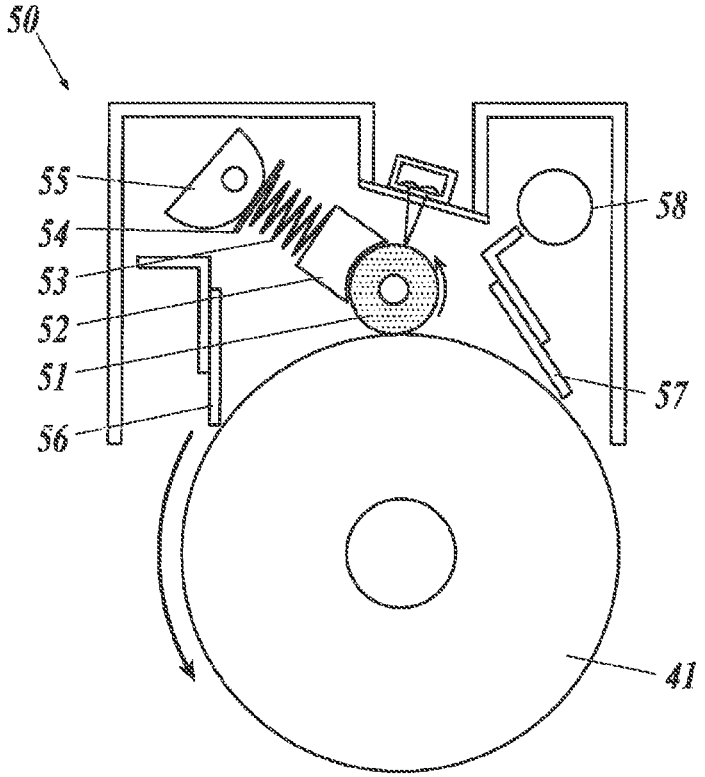
FIG. 3 is a schematic view illustrating an exemplary configuration of a lubricant applicator used to implement the process of forming an image according to the present invention.

The lubricant can be applied by any method of applying a lubricant onto the surface of the electrostatic latent image carrier. Preferably, the lubricant is applied onto the surface of the electrostatic latent image carrier with a lubricant applicator which rolls on the surface of the electrostatic latent image carrier and the surface of the lubricant, as described in detail later. The process of forming an image according to the present invention will now be described with reference to the configuration of Imaging apparatus A (FIG. 2) to which the process of forming an image according to the present invention is applied, and an exemplary lubricant applicator (FIG. 3).

A sheet feeder 10 feeds a sheet S to a sheet conveyor 20 described later. The sheet feeder 10 includes detachable sheet feeding trays 11, 12, and 13 as shown in FIG. 2. The configuration of the sheet feeder 10 will now be described. The sheet feeding trays 11, 12, and 13 each accommodate a predetermined number of sheets S. The detachable sheet feeding trays 11, 12, and 13 are each mounted on an imaging apparatus A. The sheet feeding trays 11, 12, and 13 can independently accommodate sheets S of different sizes and/or different types.

The sheet conveyor 20 transfers a sheet S fed from the sheet feeder 10 to an intermediate transfer unit 80 and a fixing unit 100 (described later), and then discharges it to the outside. The sheet conveyor 20 includes feed rollers 21, a pair of separating rollers 22, a pair of conveying rollers 23, several pairs of loop rollers 24, a pair of discharge rollers 25, and pairs of sheet reversing rollers 26 to 29, as shown in FIG. 2. The configuration of the sheet conveyor 20 will now be described. The sheet feeding trays 11, 12, and 13 each include the feed roller 21 disposed at their one end. The feed roller 21 sends out the sheet S from the sheet feeding tray 11, 12, or 13. The separating rollers 22 are each disposed downstream of the feed roller 21 to separate the sheets S fed from the feed roller 21 one by one. The conveying rollers 23 are each disposed downstream of the separating roller 22 to convey the sheet S separated by the separating roller 22 through a conveying path to the pairs of loop rollers 24.

In the sheet conveyor 20 of the imaging apparatus A, the loop rollers 24 disposed in the sheet conveyor 20 transfer the sheet S fed from the pair of conveying rollers 23 to a pair of secondary transfer rollers 91 in the intermediate transfer unit 80 (described later) while a toner image is being transferred onto the sheet S held on an intermediate transfer belt 82. The pair of discharge rollers 25 discharges the sheet S fed from the intermediate transfer unit 80 (described later) to the outside of the imaging apparatus A. The pairs of sheet reversing rollers 26 to 29 reverse the sheet S fed from the intermediate transfer unit 80, and return the sheet S through the discharge rollers 25 to the secondary transfer rollers 91 in the intermediate transfer unit 80. The sheet S is reversed through these sheet reserving rollers 26 to 29, and a toner image is transferred onto the rear surface of the sheet S.

An image scanner 30 scans an image in an original document P placed on the imaging apparatus A to store data on the image in the original document P. The image scanner 30 includes a light source 31, a scanning element 32, an imaging element 33, and an image processing circuit 34 as shown in FIG. 2. The configuration of the image scanner 30 will now be described. Light is emitted from the light source 31 onto the original document P placed on a scanning surface 35. The original document P has a printed image and/or other information. The light reflected on the original document P passes through the scanning element 32 consisting of a lens and a mirror reflector and is focused on the imaging element 33. In response to the intensity of the reflected light from the original document P through the scanning element 32, the imaging element 33 generates electric analog signals to form an image thereon. The electric analog signals generated in the imaging element 33 are converted to digital signals in the image processing circuit 34 connected to the imaging element 33. The digital signals are corrected, filtered, and compressed to be stored in the form of image data in a memory in the image processing circuit 34.

A step of developing an electrostatic latent image with a toner will now be described.

An imaging unit 40 includes a photoreceptor drum 41, which is an electrostatic latent image carrier for carrying image data, and forms a toner image based on the image data. The image data is transmitted from another apparatus, such as a personal computer (not shown), or the data on an image acquired with the image scanner 30 is stored in the memory. The imaging unit 40 includes an imaging subunit 40Y for forming a yellow (Y) image, an imaging subunit 40M for forming a magenta (M) image, an imaging subunit 40C for forming a cyan (C) image, and an imaging subunit 40K for forming a black (K) image as shown in FIG. 2. In the imaging unit 40 shown in FIG. 2, the colors of images to be formed are represented by symbols Y, M, C, and K, respectively. In the imaging unit 40, the imaging subunit 40Y, the imaging subunit 40M, the imaging subunit 40C, and the imaging subunit 40K have substantially the same configuration except for the colors of images to be formed. An exemplary configuration of the imaging unit 40 will be described with reference to the imaging subunit 40K for forming a black (K) image.

The imaging subunit 40K includes a photoreceptor drum 41K (a photoreceptor unit), a charging unit 42K, an optical writing unit 43K, and a developing unit 44K. The configuration of the imaging subunit 40K will now be described. The surface of the photoreceptor drum 41K carries an electrostatic latent image corresponding to the image data. The surface of the photoreceptor drum 41K is uniformly charged by the charging unit 42K. The optical writing unit 43K emits light based on the image data (image information signals) onto the surface of the photoreceptor drum 41K to form an electrostatic latent image on the surface of the photoreceptor drum 41K. The image data corresponds to the image data of the original document P transmitted from another apparatus, such as a personal computer, or the data on the image of the original document P acquired with the image scanner 30 and stored in the memory. The developing unit 44K includes a developer feeding roller, a developing roller, and a thickness regulating blade. In the developing unit 44K, a developer is fed from the developer feeding roller, is adjusted to a predetermined thickness by the thickness regulating blade, and then is fed through the developing roller to the photoreceptor drum 41K. The electrostatic latent image formed on the surface of the photoreceptor drum 41K is developed with the developer fed from the developing unit 44K to form a toner image.

The intermediate transfer unit 80 temporarily transfers the toner image formed in the imaging unit 40 onto an endless intermediate transfer belt 82. The intermediate transfer unit 80 includes a primary transfer roller 81, the intermediate transfer belt 82, and a tension roller 83 as shown in FIG. 2. The configuration of the intermediate transfer unit 80 will now be described. The primary transfer roller 81 is opposite to the photoreceptor drum 41 through which the intermediate transfer belt 82 travels. The primary transfer rollers 81Y, 81M, 81C, and 81K are opposite to the photoreceptor drums 41 disposed in the imaging subunits 40Y, 40M, 40C, and 40K, respectively. The toner image is temporarily transferred onto the intermediate transfer belt 82. The toner images of the respective colors formed in the imaging subunits 40Y, 40M, 40C, and 40K are sequentially transferred onto the rotating intermediate transfer belt 82. The intermediate transfer belt 82 thereby has a color image of superimposed toner images of yellow (Y), magenta (M), cyan (C), and black (K) colors. The tension rollers 83 are disposed at some positions on the transfer belt 82, such as both ends, to move the intermediate transfer belt 82 under a predetermined tension.

The secondary transfer unit 90 transfers the toner image, which is temporarily transferred onto the intermediate transfer belt 82 in the intermediate transfer unit 80, onto the sheet S conveyed by the sheet conveyor 20. The secondary transfer unit 90 includes a pair of secondary transfer rollers 91 as shown in FIG. 2. The configuration of the secondary transfer unit 90 will now be described. The pair of secondary transfer rollers 91 is disposed downstream of one of the tension rollers 83 to hold and press the intermediate transfer belt 82 carrying a temporarily transferred toner image and the sheet S. The toner image on the intermediate transfer belt 82 is electrically transferred onto the sheet S by a predetermined voltage (V) applied to the secondary transfer roller 91.

The fixing unit 100 fixes the toner image transferred onto the sheet S by the intermediate transfer unit 80. The fixing unit 100 includes a heating roller 101 and a pressurizing roller 102 as shown in FIG. 2. The configuration of the fixing unit 100 will now be described. The heating roller 101 and the pressurizing roller 102 are disposed to hold and press the sheet S transferred by the sheet conveyor 20. The heating roller 101 has a heater (not shown) inside thereof. The toner image adhering on the surface of the sheet S by an electrostatic force is melt under pressure by the heating roller 101 and the pressurizing roller 102 to be fixed to the sheet S.

The sheet feeder 10, the sheet conveyor 20, the image scanner 30, the imaging unit 40, a lubricant applying unit 50, the intermediate transfer unit 80, and the fixing unit 100 are controlled by a control unit 110 under predetermined conditions to fix the image on the sheet S.

The lubricant applying unit 50 applies a lubricant 52 onto the surface of the photoreceptor drum 41. The lubricant applying unit 50 includes a lubricant applying brush 51, a lubricant 52, a pressurizing spring 53, a pressurizing plate 54, a pressure adjusting cam 55, a smoothing blade 56, a cleaning blade 57, and a toner recovering member 58 as shown FIG. 3. The lubricant applying brush 51 corresponds to the lubricant applicator. The configuration of the lubricant applying unit 50 and the step of applying a lubricant onto the surface of the electrostatic latent image carrier will now be described.

The lubricant applying brush 51 in the lubricant applying unit 50 corresponds to the lubricant applicator. The lubricant applying brush 51 rolls on the surface of the photoreceptor drum 41 and the surface of the lubricant 52 as shown in FIG. 3 to apply the lubricant 52 onto the photoreceptor drum 41. The lubricant applying brush 51 is composed of a brush or acrylic carbon fibers planted in a core at predetermined pile density, pile diameter, and pile length. The lubricant applying brush 51 may be composed of fibers planted in a sheet and a core covered with the sheet. Any lubricant applicator other than the brush can be used, and may be a roll capable of applying the lubricant 52, for example. The pressurizing spring 53 presses the solid lubricant 52, which in turn, presses the lubricant applying brush 51. If the lubricant applying brush 51 rotates about the core in this state, the solid lubricant 52 is scraped by the brush. The powdery lubricant 52 scraped by the lubricant applying brush 51 is then applied onto the surface of the photoreceptor drum 41. The lubricant 52 reduces the frictional force between the photoreceptor drum 41 and the cleaning blade 57 to protect the surface of the photoreceptor drum 41 and clean off residues on the surface of the photoreceptor drum 41. The lubricant 52 is a solid composed of zinc stearate (ZnSt) or calcium stearate (CaSt), for example.

The solid lubricant 52 is urged against the lubricant applying brush 51 by the pressurizing spring 53 in the lubricant applying unit 50 as shown in FIG. 3. The pressurizing spring 53 is composed of a metal wire coil. The pressurizing plate 54 in the lubricant applying unit 50 is disposed between the pressurizing spring 53 and the pressure adjusting cam 55 to transmit the action of the pressure adjusting cam 55 to the pressurizing spring 53. The pressurizing plate 54 is composed of a rectangular aluminum shape, for example. As shown in FIG. 3, the pressure adjusting cam 55 in the lubricant applying unit 50 adjusts the pressure applied to the lubricant 52 by the pressurizing spring 53 through the pressurizing plate 54 in contact with the pressure adjusting cam 55 to vary the pressure applied to the photoreceptor drum 41 by the lubricant applying brush 51. The pressure adjusting cam 55 is a cylinder composed of stainless steel. The outer peripheral surface of the pressure adjusting cam 55 is eccentrically formed in the rotational direction with respect to the central axis of the cam. Rotation of the pressure adjusting cam 55 then varies the contact position between the pressure adjusting cam 55 and the pressurizing plate 54. According to the variation in contact position between the pressure adjusting cam 55 and the pressurizing plate 54, the pressurizing spring 53 is compressed or expanded to adjust the pressure applied to the lubricant 52 by the pressurizing spring 53 and vary the pressure applied to the photoreceptor drum 41 by the lubricant applying brush 51.

As shown in FIG. 3, the smoothing blade 56 in the lubricant applying unit 50 is in contact with the surface of the photoreceptor drum 41 at an acute angle in the axial direction to smooth unevenness of the coating of the lubricant 52 applied onto the surface of the photoreceptor drum 41. The smoothing blade 56 is composed of a urethane rubber plate and in contact with the entire width of the photoreceptor drum 41, for example. As shown in FIG. 3, the cleaning blade 57 in the lubricant applying unit 50 is in contact with the surface of the photoreceptor drum 41 at an acute angle in the axis direction to clean up residues on the surface of the photoreceptor drum 41. The cleaning blade 57, like the smoothing blade 56, is composed of a urethane rubber plate and in contact with the entire width of the photoreceptor drum 41, for example. The residues are excess toner not transferred onto the surface of the photoreceptor drum 41 and/or impurities, such as ion products generated during charging.

Sheet

The sheet S used in the process of forming an image according to the present invention is a medium for holding a toner image. Specific examples thereof include, but should not be limited to, a variety of media having different thicknesses, such as plain paper; high quality paper; coated print paper, such as art paper or coated paper; and commercially available products, such as Japanese paper, post cards, plastic films for overhead projectors (OHPs), and cloths.

According to the process of forming an image, the toner used in the process comprises silica-polymer composite nanoparticles, which prune excess lubricant adhering on the electrostatic latent image carrier to reduce uneven charge of the electrostatic latent image carrier and prevent wear of the cleaning blade. Furthermore, the silica-polymer composite nanoparticles do not damage the surface of the cleaning blade or the surface of the electrostatic latent image carrier. Accordingly, the process can stably form high-quality images over a long time without uneven charge of the electrostatic latent image carrier. The silica-polymer composite nanoparticles contained in the toner reduce uneven charge caused by excess lubricant without damage of the cleaning blade and the electrostatic latent image carrier for the reason that the silica portion of the silica-polymer composite nanoparticles probably functions as a polisher and the polymer portion absorbs excess pressure.

Embodiments according to the present invention should not be limited to the embodiments described in detail above, and can be modified in various ways.

EXAMPLES

The present invention will now be described in detail by way of non-limiting Examples. In Examples, "parts" and "%" are on the mass basis, unless otherwise specified.

Preparation of Silica-Polymer Composite Nanoparticles

Process of Preparing Silica-Polymer Composite Nanoparticles 1

A Ludox AS-40 colloidal silica dispersion (W.R. Grace & Co., number average primary particle diameter: 25 nm, BET SA: 126 $m^2/g$, pH: 9.1, silica content: 40 mass %) (18.7 g), deionized water (125 mL), and a first hydrophobic agent methacryloxypropyltrimethoxysilane (15.0 g) (CAS #2530-85-0, Mw: 248.3) were placed in a 250 mL four-necked round-bottomed flask equipped with an over-head stirring motor, a condenser, and a thermocouple. The mass ratio $M_{MON}/M_{silica}$ was 2.0:1.

The reaction mixture was heated to 65° C. While the mixture was being stirred at 120 rpm, the nitrogen gas was bubbled into the mixture for 30 minutes. After three hours, a solution (10 mL) of a radical initiator 2,2'-azobisisobutyronitrile (abbreviated to AIBN, CAS #78-67-1, Mw: 164.2, 0.16 g) in ethanol was added to the reaction mixture (methacryloxypropyltrimethoxysilane: 1 mass % or less), and was heated to 75° C.

After radical polymerization for five hours, a second hydrophobic agent 1,1,1,3,3,3-hexamethyldisilazane (HMDS) (3 mL, 2.3 g, 0.014 mol) was added to the mixture. The reaction was continued for further 3 hours. The final mixture was filtered with a 170 mesh sieve to remove coarse aggregated particles. The dispersion was placed in a Pyrex (registered trademark) tray, and was dried at 120° C. overnight. A white powdery solid was collected on the next day. The solid was pulverized with an IKA M20 Universal mill to prepare Silica-polymer composite nanoparticles 1. The number average primary particle diameter of Silica-polymer composite nanoparticles 1 was 106 nm, and the percentage of atomic silicon was 24.8 atm %. The number average primary particle diameter of Silica-polymer composite nanoparticles 1 was determined as follows. The silica-polymer composite nanoparticles were photographed with a scanning electron microscope "JSM-7401F" (available from JEOL, Ltd.) at a magnification of 30000, and the photographed image was taken in with a scanner. Images of particles were analyzed with an image processing analyzer "LUZEX (registered trademark) AP" (available from NIRECO CORPORATION). The percentage of atomic silicon was determined with an X-ray photoelectron spectrometer "K-Alpha" (available from Thermo Fisher Scientific Inc.).

Preparation of Silica-Polymer Composite Nanoparticles 2 to 9

"Silica-polymer composite nanoparticles 2 to 9" having different number average primary particle diameters were prepared as in Silica-polymer composite nanoparticles 1 except that the particle diameter of colloidal silica, and the mass ratio $M_{MON}/M_{silica}$ were varied as shown in Table 1.

Preparation of Silica-Polymer Composite Nanoparticles 10 and 11

Silica-polymer composite nanoparticles 10 were prepared as in Silica-polymer composite nanoparticles 1 except that the first hydrophobic agent was (3-acryloxypropyl) trimethoxysilane (CAS #4369-14-6, Mw: 234.3) and the second hydrophobic agent was isobutyltrimethoxysilane as shown in Table 1. Silica-polymer composite nanoparticles 11 were prepared as in Silica-polymer composite nanoparticles 1 except that the first hydrophobic agent was methacryloxypropyltriethoxysilane (CAS #21142-29-0, Mw: 290.4) and the second hydrophobic agent was octyltriethoxysilane.

being stirred at 230 rpm under a nitrogen stream, the inner temperature of the reaction vessel was raised to 80° C. After the heating, a solution of potassium persulfate (10 parts by mass) in deionized water (200 parts by mass) was added, and the reaction solution was reheated to 80° C. A polymerizable monomer solution containing styrene (480 parts by mass), n-butyl acrylate (250 parts by mass), methacrylic acid (68.0 parts by mass), and n-octyl-3-mercapto propionate (16.0 parts by mass) were added dropwise over one hour, and were heated at 80° C. for two hours with stirring for polymerization. Polymer nanoparticle dispersion (1H) containing polymer nanoparticles (1 h) was prepared.

Second Polymerization

A first solution of polyoxyethylene-2-dodecyl ether sodium sulfate (7 parts by mass) in deionized water (800 parts by mass) was placed in a reaction vessel equipped with a stirrer, a thermosensor, a cooling tube, and a nitrogen inlet, and was heated to 98° C. Polymer nanoparticle dispersion (1H) (260 parts by mass), styrene (245 parts by mass), n-butyl acrylate (120 parts by mass), n-octyl-3-mercapto propionate (1.5 parts by mass), and paraffin wax "HNP-11" (available from NIPPON SEIRO CO., LTD., 67 parts by mass) as a mold release agent were dissolved at 90° C. to prepare a polymerizable monomer solution. The polymerizable monomer solution was added to the first solution, and the mixture was dispersed in a mechanical dispersing

TABLE 1

| | Material | | | | Silica-Polymer Composite Nanoparticle | |
|---|---|---|---|---|---|---|
| | Colloidal Silica | | | | | |
| Silica-Polymer Composite Nanoparticle No. | Number Average Primary Particle Size (nm) | First Hydrophobic Agent | $M_{MON}/M_{silica}$ | Second Hydrophobic Agent | *1 (nm) | % of Atomic Silicon (atm %) |
| Silica-Polymer Composite Nanoparticle 1 | 25 | *2 | 2.0 | Hexamethyldisilazane | 106 | 24.8 |
| Silica-Polymer Composite Nanoparticle 2 | 25 | *2 | 1.2 | Hexamethyldisilazane | 50 | 25.1 |
| Silica-Polymer Composite Nanoparticle 3 | 25 | *2 | 16.0 | Hexamethyldisilazane | 500 | 25.4 |
| Silica-Polymer Composite Nanoparticle 4 | 25 | *2 | 1.8 | Hexamethyldisilazane | 45 | 24.6 |
| Silica-Polymer Composite Nanoparticle 5 | 25 | *2 | 18.0 | Hexamethyldisilazane | 550 | 24.9 |
| Silica-Polymer Composite Nanoparticle 6 | 12 | *2 | 2.0 | Hexamethyldisilazane | 113 | 15.2 |
| Silica-Polymer Composite Nanoparticle 7 | 40 | *2 | 2.0 | Hexamethyldisilazane | 95 | 29.7 |
| Silica-Polymer Composite Nanoparticle 8 | 7 | *2 | 2.0 | Hexamethyldisilazane | 121 | 13.8 |
| Silica-Polymer Composite Nanoparticle 9 | 55 | *2 | 2.0 | Hexamethyldisilazane | 85 | 31.5 |
| Silica-Polymer Composite Nanoparticle 10 | 25 | (3-Acryloxypropyl) trimethoxysilane | 2.0 | Isobutyltrimethoxysilane | 108 | 25.3 |
| Silica-Polymer Composite Nanoparticle 11 | 25 | *2 | 2.0 | Octyltriethoxysilane | 103 | 25.6 |

*1: Number Average Primary Particle Size
*2: Methacryloxypropyltrimethoxysilane

Preparation of Toner

1. Production Example of Toner Matrix Particles (1) (Production Example of Toner Matrix Particles Having Styrene-Acrylic Single-Layer Structure)

(1) Production Example of Polymer Nanoparticle Dispersion (1)

First Polymerization

A solution of sodium dodecyl sulfate (8 parts by mass) in deionized water (3000 parts by mass) was placed in a reaction vessel equipped with a stirrer, a thermosensor, a cooling tube, and a nitrogen inlet. While the solution was machine "CREARMIX" having a circulating path (available from M Technique Co., Ltd.) for one hour to prepare a dispersion containing emulsion particles (oil droplets).

An initiator solution of potassium persulfate (6 parts by mass) in deionized water (200 parts by mass) was then added to the dispersion, and the system was heated with stirring at 82° C. for one hour for polymerization to prepare Polymer nanoparticle dispersion (1HM) containing Polymer nanoparticles (1hm).

Third Polymerization

A solution of potassium persulfate (11 parts by mass) in deionized water (400 parts by mass) was added to Polymer nanoparticle dispersion (1HM), and a polymerizable monomer solution containing styrene (435 parts by mass), n-butyl acrylate (130 parts by mass), methacrylic acid (33 parts by mass), and n-octyl-3-mercapto propionate (8 parts by mass) was added dropwise at 82° C. over one hour. The solution was then heated with stirring over two hours for polymerization, and then was cooled to 28° C. to prepare Polymer nanoparticle dispersion (1) containing Polymer nanoparticles (a). The diameter of Polymer nanoparticles (a) in Polymer nanoparticle dispersion (1) was determined with an electrophoretic light scattering photometer ELS-800 (available form Otsuka Electronics Co., Ltd.). The volume median diameter was 150 nm. The glass transition temperature of Polymer nanoparticles (a) was 45° C. from the measurement.

(2) Preparation of Colorant Nanoparticle Dispersion (1)

While a solution of sodium dodecyl sulfate (90 parts by mass) in deionized water (1600 parts by mass) was being stirred, carbon black "REGAL 330R" (available from Cabot Corporation, 420 parts by mass) was gradually added, and then was dispersed with an agitator "Cleamix" (available from M Technique Co., Ltd.) to prepare Colorant nanoparticle dispersion (1). The diameter of the colorant nanoparticles in Colorant nanoparticle dispersion (1) was 110 nm from the measurement with an electrophoretic light scattering photometer ELS-800 (available form Otsuka Electronics Co., Ltd.).

(3) Preparation of Toner Matrix Particles (1)

Polymer nanoparticle dispersion (1) (300 parts by mass in solid content), deionized water (1400 parts by mass), Colorant nanoparticle dispersion (1) (120 parts by mass), and polyoxyethylene-2-dodecyl ether sodium sulfate (3 parts by mass) were dissolved in deionized water (120 parts by mass) to prepare a solution. The solution was placed in a reaction vessel equipped with a stirrer, a thermosensor, a cooling tube, and a nitrogen inlet, and the temperature of the solution was adjusted to 30° C. A 5N sodium hydroxide aqueous solution was added to adjust the pH to 10.

An aqueous solution of magnesium chloride (35 parts by mass) deionized water (35 parts by mass) was added under stirring at 30° C. for 10 minutes. After being kept for three minutes, the system was heated to 90° C. over 60 minutes. While the system was kept at 90° C., the reaction was continued to grow particles.

In this state, the diameter of integrated particles was measured with a particle size analyzer "Coulter Multisizer III." When the volume median diameter ($D_{50}$) reached 6.0 μm, an aqueous solution of sodium chloride (150 parts by mass) in deionized water (600 parts by mass) was added to terminate the growth of particles. In the next fusion step, the solution was heated with stirring at a solution temperature of 98° C. to fuse the particles until the average circularity determined with a dynamic flow particle imaging analyzer "FPIA-2100" reached 0.955. Subsequently, the solution was cooled to 30° C., hydrochloric acid was added to adjust the pH to 4.0, and the stirring was stopped.

The dispersion prepared in this step was separated with a basket centrifuge "MARK III 60×40+M" (available from Matsumoto Machine Manufacturing Co., Ltd.) to prepare wet cake of colored particles. The wet cake was washed with deionized water at 45° C. in the basket centrifuge until the electric conductivity of the filtrate reached 5 μS/cm. The wet cake was then placed in a "Flash Jet" dryer (available from Seishin Enterprise Co., Ltd.), and was dried until a moisture content of 0.5 mass %. Toner matrix particles (1) were prepared.

2. Production Example of Toner Matrix Particles (2) (Production Example 1 of Toner Matrix Particles Having Domain-Matrix Structure)

(1) Preparation of Polymer Nanoparticle Dispersion (2)

First Polymerization

Sodium lauryl sulfate (2.0 parts by mass) as an anionic surfactant was preliminarily dissolved in deionized water (2900 parts by mass) to prepare an anionic surfactant solution, and the anionic surfactant solution was placed in a reaction vessel equipped with a stirrer, a thermosensor, a temperature controller, a cooling tube, and a nitrogen inlet. While the solution was being stirred at 230 rpm under a nitrogen stream, the inner temperature of the reaction vessel was raised to 80° C.

Potassium persulfate (KPS) (9.0 parts by mass) as a polymerization initiator was added to the anionic surfactant solution, and the inner temperature was adjusted to 78° C. Monomer solution [1] containing styrene (540 parts by mass), n-butyl acrylate (154 parts by mass), methacrylic acid (77 parts by mass), and n-octyl mercaptan (17 parts by mass) was added dropwise over three hours. The solution was then heated at 78° C. over one hour with stirring for polymerization (first polymerization) to prepare a dispersion of Polymer nanoparticles [a1].

Second Polymerization: Preparation of Intermediate Layer

In a flask equipped with a stirrer, paraffin wax (melting point: 73° C., 51 parts by mass) as an off-set inhibitor was added to a solution containing styrene (94 parts by mass), n-butyl acrylate (27 parts by mass), methacrylic acid (6 parts by mass), and n-octyl mercaptan (1.7 parts by mass), and was dissolved by being heated to 85° C. to prepare Monomer solution [2].

A surfactant solution containing sodium lauryl sulfate (2 parts by mass) as an anionic surfactant and deionized water (1100 parts by mass) was heated to 90° C. The dispersion of Polymer nanoparticles [a1] was added in an amount of 28 parts by mass in solid content of Polymer nanoparticles [a1] to the surfactant solution. Monomer solution [2] was dispersed in a mechanical dispersing machine "Cleamix" having a circulation path (available from M Technique Co., Ltd.) for four hours to prepare a dispersion containing emulsion particles having a particle diameter of 350 nm. An initiator aqueous solution of KPS (2.5 parts by mass) as a polymerization initiator in deionized water (110 parts by mass) was added to the dispersion, and the system was heated to 90° C. over two hours with stirring for polymerization (second polymerization). A dispersion of Polymer nanoparticles [a11] was prepared.

Third Polymerization: Formation of Outer Layer

An initiator aqueous solution of KPS (2.5 parts by mass) as a polymerization initiator in deionized water (110 parts by mass) was added to the dispersion of Polymer nanoparticles [a11]. Monomer solution [3] containing styrene (230 parts by mass), n-butyl acrylate (78 parts by mass), methacrylic acid (16 parts by mass), and n-octyl mercaptan (4.2 parts by mass) was added dropwise at 80° C. for one hour. The solution was then heated with stirring for three hours for polymerization (third polymerization), and was then cooled to 28° C. to prepare Polymer nanoparticle dispersion (2) having Polymer nanoparticles (2) dispersed in the anionic surfactant solution. Polymer nanoparticles (2) had a glass transition temperature of 45° C. and a softening point of 100° C.

(2) Preparation of Styrene-Acrylic Modified Polyester Nanoparticle Dispersion (1)

(2-1) Preparation of Styrene-Acrylic Modified Polyester (1)

Bisphenol A propylene oxide 2 mol adduct (500 parts by mass), terephthalic acid (117 parts by mass), fumaric acid (82 parts by mass), and an esterifying catalyst (tin octylate) (2 parts by mass) were placed in a reaction vessel equipped with a nitrogen inlet pipe, a dehydration tube, a stirrer, and a thermocouple, and were heated at 230° C. for eight hours for condensation polymerization reaction. The product was further reacted under 8 kPa for one hour, and was cooled to 160° C. In the next step, a mixture of acrylic acid (10 parts by mass), styrene (30 parts by mass), n-butyl acrylate (7 parts by mass), and a polymerization initiator (di-t-butyl peroxide) (10 parts by mass) was added dropwise through a dropping funnel over one hour. After the dropping, an addition polymerization reaction was continued for one hour while the solution was kept at 160° C. The resultant was then heated to 200° C., and was kept at 10 kPa for one hour. Acrylic acid, styrene, and butyl acrylate were removed to prepare Styrene-acrylic modified polyester (1). Styrene-acrylic modified polyester (1) had a glass transition temperature of 60° C. and a softening point of 105° C.

(2-2) Preparation of Styrene-Acrylic Modified Polyester Nanoparticle Dispersion (1)

Styrene-acrylic modified polyester (1) (100 parts by mass) was pulverized with a grinding machine "Roundel Mill RM" (available from TOKUJU CORPORATION). The pulverized product was mixed with an aqueous 0.26 mass % sodium lauryl sulfate solution (638 parts by mass), and was ultrasonically dispersed with stirring in an ultrasonic homogenizer "US-150T" (available from NIHONSEIKI KAISHA LTD.) at V-LEVEL and 300 μA for 30 minutes to prepare Dispersion (1) of styrene-acrylic modified polyester nanoparticles having a volume median diameter ($D_{50}$) of 250 nm.

(3) Preparation of Toner Matrix Particles (2) (Aggregation, Fusion, Aging, Washing, Drying Steps)

Polymer nanoparticle dispersion (2) (288 parts by mass in solid content), Dispersion (1) of styrene-acrylic modified polyester nanoparticles (72 parts by mass in solid content), and deionized water (2000 parts by mass) were placed in a reaction vessel equipped with a stirrer, a thermosensor, and a cooling tube, and a sodium hydroxide aqueous solution (5 mol/L) was added to adjust the pH to 10.

Colorant nanoparticle dispersion (1) (40 parts by mass in solid content) was added, and an aqueous solution of magnesium chloride (60 parts by mass) in deionized water (60 parts by mass) was added under stirring at 30° C. over 10 minutes. After the solution was left to stand for three minutes, the solution was heated to 80° C. over 60 minutes. While the solution was kept at 80° C., the reaction was continued to grow particles.

In this state, the diameter of core particles was measured with a particle size analyzer "Coulter Multisizer 3" (available from Beckman Coulter, Inc.). When the volume median diameter ($D_{50}$) reached 6.0 μm, an aqueous solution of sodium chloride (190 parts by mass) in deionized water (760 parts by mass) was added to terminate the growth of particles. The reaction product was heated with stirring at 90° C. to fuse the particles. When the average circularity determined with a dynamic flow particle imaging analyzer "FPIA-2100" (available from Sysmex Corporation) (HPF density of 4000) reached 0.945, the reaction product was cooled to 30° C. to prepare Toner matrix particle dispersion (2).

Toner matrix particle dispersion (2) was separated with a centrifuge to prepare wet cake of toner matrix particles. The wet cake was washed with deionized water at 35° C. in the centrifuge until an electric conductivity of the filtrate of 5 μS/cm. The wet cake was then placed in a "Flash Jet" dryer (available from Seishin Enterprise Co., Ltd.), and was dried until a moisture content of 0.5 mass %.

Colored particles were separated from the reaction product with a basket centrifuge "MARK III 60×40+M" (available from Matsumoto Machine Manufacturing Co., Ltd.) to prepare wet cake of colored particles. The wet cake was washed with deionized water at 45° C. in the basket centrifuge until the electric conductivity of the filtrate reached 5 μS/cm. The wet cake was then placed in a "Flash Jet" dryer (available from Seishin Enterprise Co., Ltd.), and was dried until a moisture content of 0.5 mass %. Toner matrix particles (2) having a domain-matrix structure were prepared.

3. Production Example of Toner Matrix Particles (3) (Production Example 2 of Toner Matrix Particles Having Domain-Matrix Structure)

(1) Preparation of Dispersion (1) of Vinyl Polymer Nanoparticles Having Acid Groups First Polymerization Polyoxyethylene (2) dodecyl ether sodium sulfate (4 parts by mass) and deionized water (3000 parts by mass) were placed in a reaction vessel equipped with a stirrer, a thermosensor, a cooling tube, and a nitrogen inlet. While the solution was being stirred at 230 rpm under a nitrogen stream, the inner temperature of the reaction vessel was raised to 80° C. After this operation, a solution of potassium persulfate (10 parts by mass) in deionized water (200 parts by mass) was added, and the solution temperature was adjusted to 75° C. A monomer mixed solution containing styrene (584 parts by mass), n-butyl acrylate (160 parts by mass), and methacrylic acid (56 parts by mass) was added dropwise over one hour. The solution was heated with stirring at 75° C. for two hours for polymerization. A dispersion of Polymer nanoparticles [b1] was prepared.

Second Polymerization

A solution of polyoxyethylene (2) dodecyl ether sodium sulfate (2 parts by mass) in deionized water (3000 parts by mass) was placed in a reaction vessel equipped with a stirrer, a thermosensor, a cooling tube, and a nitrogen inlet, and was heated to 80° C. The Polymer nanoparticles [b1] (42 parts by mass in solid content) and microcrystalline wax "HNP-0190" (available from NIPPON SEIRO CO., LTD., 70 parts by mass) were dissolved in a monomer solution containing styrene (239 parts by mass), n-butyl acrylate (111 parts by mass), methacrylic acid (26 parts by mass), and n-octyl mercaptan (3 parts by mass) at 80° C. to prepare a solution. The solution was added to the reaction solution, and was dispersed in a mechanical dispersing machine "CLEARMIX" having a circulation path (available from M Technique Co., Ltd.) for one hour to prepare a dispersion containing emulsion particles (oil droplets).

An initiator solution of potassium persulfate (5 parts by mass) in deionized water (100 parts by mass) was added to the dispersion, and the system was heated with stirring at 80° C. over one hour for polymerization. A dispersion of Polymer nanoparticles [b2] was prepared.

Third Polymerization

A solution of potassium persulfate (10 parts by mass) in deionized water (200 parts by mass) was added to the dispersion of Polymer nanoparticles [b2], and the monomer mixed solution containing styrene (380 parts by mass), n-butyl acrylate (132 parts by mass), methacrylic acid (39 parts by mass), and n-octyl mercaptan (6 parts by mass) was added dropwise to the dispersion at 80° C. over one hour. The dispersion was then heated with stirring over two hours for polymerization. The dispersion was cooled to 28° C. to prepare Dispersion (1) of vinyl polymer nanoparticles having acid groups.

(2) Preparation of Styrene-Acrylic Modified Polyester (2)

Sebacic acid (molecular weight: 202.25, 259 parts by mass) as a polyvalent carboxylic acid compound (material for a polyester polymer segment) and 1,12-dodecanediol (molecular weight: 202.33, 259 parts by mass) as polyhydric alcohol were placed in a reaction vessel equipped with a nitrogen inlet pipe, a dehydration tube, a stirrer, and a thermocouple, and were dissolved by being heated to 160° C. A premixed solution (for material for a vinyl polymer segment) of styrene (46 parts by mass), n-butyl acrylate (12 parts by mass), dicumyl peroxide (4 parts by mass), and acrylic acid (3 parts by mass) as a bireactive monomer was added dropwise through a dropping funnel over one hour.

The solution was kept at 170° C. and continuously stirred for one hour to polymerize styrene, n-butyl acrylate, and acrylic acid. Tin(II) 2-ethylhexanoate (2.5 parts by mass) and gallic acid (0.2 parts by mass) were then added. The mixture was heated to 210° C., and the reaction was performed for eight hours. The reaction was further performed under 8.3 kPa for one hour to prepare Styrene-acrylic modified polyester (2) composed of a vinyl polymer segment and a polyester polymer segment combined therewith.

Styrene-acrylic modified polyester (2) had a melting point (Tm) of 82.2° C., which was determined from the endothermic peak temperature in the DSC curve produced from the measurement at a heating rate of 10° C./min with a differential scanning calorimeter "Diamond DSC" (available from PerkinElmer Inc.). The molecular weight Mw equivalent to standard styrene was 28000 from the measurement with "HLC-8120 GPC" (available from Tosoh Corporation) as described above.

(3) Preparation of Dispersion (2) of Styrene-Acrylic Modified Polyester Nanoparticles Styrene-acrylic modified polyester (2) (30 parts by mass) was melt, and was fed as it was at a feeding rate of 100 parts by mass/min with an emulsion dispersing machine "CAVITRON CD1010" (available from Eurotec, Ltd.). Simultaneously with the melting and feeding of Styrene-acrylic modified polyester (2), an reagent-grade aqueous ammonia (70 parts by mass) was diluted with deionized water in an aqueous solvent tank, and the diluted solution of 0.37 mass % ammonia was fed to the emulsion dispersing machine at a feeding rate of 0.1 parts by mass/min while being heated to 100° C. with a heat exchanger. The emulsion dispersing machine was operated at a rotational speed of 60 Hz of a rotor and a pressure of 5 kg/cm$^2$ to prepare Dispersion (2) of styrene-acrylic modified polyester nanoparticles (volume median diameter: 200 nm, solid content: 30 parts by mass).

(4) Preparation of Toner Matrix Particles (3) Aggregation and Fusion

Dispersion (1) of vinyl polymer nanoparticles having acid groups (300 parts by mass in solid content), Dispersion (2) of styrene-acrylic modified polyester nanoparticles (60 parts by mass in solid content), deionized water (1100 parts by mass), and Colorant nanoparticle dispersion (1) (40 parts by mass in solid content) were placed in a reaction vessel equipped with a stirrer, a thermosensor, a cooling tube, and a nitrogen inlet, and the solution temperature was adjusted to 30° C. A 5N sodium hydroxide aqueous solution was added to adjust the pH to 10.

An aqueous solution of magnesium chloride (60 parts by mass) in deionized water (60 parts by mass) was added under stirring at 30° C. over 10 minutes. After the solution was kept for three minutes, the system was heated to 85° C. over 60 minutes. While the system was kept at 85° C. the reaction was continued to grow particles by integration. In this state, the diameter of the aggregated particles was measured with a particle size analyzer "Coulter Multisizer 3" (available from Beckman Coulter, Inc.). When the volume median diameter reached 6 μm, an aqueous solution of sodium chloride (40 parts by mass) in deionized water (160 parts by mass) was added to terminate the growth of particles. In the next aging step, the solution was heated with stirring at a solution temperature of 80° C. over one hour to fuse the particles. When the average circularity determined with a dynamic flow particle imaging analyzer "FPIA-2100" (available from Sysmex Corporation) (HPF density of 4000) reached 0.948, the solution was cooled to 30° C. to prepare Toner matrix particle dispersion (3) having a domain-matrix structure.

Washing and Drying

Toner matrix particle dispersion (3) was separated with a basket centrifuge "MARK III 60×40+M" (available from Matsumoto Machine Manufacturing Co., Ltd.) to prepare wet cake of Toner matrix particles (3). The wet cake was washed with deionized water at 40° C. in the basket centrifuge until the electric conductivity of the filtrate reached 5 μS/cm. The wet cake was placed in a "Flash Jet" dryer (available from Seishin Enterprise Co., Ltd.), and was dried until a moisture content of 0.5 mass %. Toner matrix particles (3) were prepared.

Preparation of Toner (Bk-1) (Addition of External Additive)

Silica-polymer composite nanoparticles 1 (1.0 part by mass), fumed silica (HMDS-treated, degree of hydrophobization: 69%, number average primary particle diameter: 30 nm, 0.65 parts by mass), and hydrophobic titania (octylsilane-treated, degree of hydrophobization: 60%, number average primary particle diameter: 30 nm, 0.25 parts by mass) were added to Toner matrix particles (1), and were mixed with a Henschel mixer to prepare Toner (Bk-1).

Toners (Bk-2) to (Bk-19)

Toners (Bk-2) to (Bk-19) were prepared as in Toner (Bk-1) except that the types and the amounts of the toner matrix particles and the silica-polymer composite nanoparticles were varied as shown in Table 2.

Toners (Bk-17) to (Bk-19) were prepared as in Toner (Bk-1) except that silica-polymer composite nanoparticles were replaced with calcium titanate (TC-100, available from Titan Kogyo, Ltd.), strontium titanate (SW-100, available from Titan Kogyo, Ltd.), and silica (YC100C-SP3, available from Admatechs Company Limited), respectively. Toners (Bk-1) to (Bk-14) fell into the present invention while Toners (Bk-15) to (Bk-19) fell into Comparative Examples.

Production Examples of Developers: Preparation of Developers [Bk-1] to [Bk-19]

Toners (Bk-1) to (Bk-19) were each mixed with a ferrite carrier (volume average particle diameter: 60 μm) coated with a silicone polymer in a toner content of 6% to prepare Developers [Bk-1] to [Bk-19].

Examples 1 to 14, Comparative Examples 1 to 5

A lubricant applicator including a lubricant applicator shown in FIG. 3 was installed in a digital copier "bizhub PRO C450" (available from KONICA MINOLTA, INC.). Developers [Bk-1] to [Bk-19] containing Toners (Bk-1) to (Bk-19), respectively, were used to perform the following print test for evaluation of uneven charge and wear of the photoreceptor. The lubricant used was zinc stearate.

Evaluation of Uneven Charge

Under an environment at normal temperature and normal humidity (temperature: 20° C., humidity: 55% RH), size A4 plain paper was used as an image support, a halftone image having an absolute reflection density of 0.50 (referred to as "initial image") was printed on the first or initial sheet. After an image having a coverage of 5% was printed on 50000 sheets in an intermittent mode, a halftone image having a reflection density of 0.50 (referred to as "image after 50000 prints") was printed on one sheet. In each of the initial image and the image after 50000 prints, the reflection densities in 20 places were measured, and the difference between the maximum and the minimum was determined. A difference between the maximum and the minimum more than 0.05 caused practical problems, and was determined as failure. The density was measured with a reflection densitometer "RD-918" (available from Gretag Macbeth GmbH).

Evaluation of Wear of Electrostatic Latent Image Carrier

The thickness of the electrostatic latent image carrier after 50000 prints in the evaluation of uneven charge was measured, and the difference in thickness of the electrostatic latent image carrier before the initial print and after 50000 prints was defined as wear. A wear level of more than 0.5 μm caused practical problems, and was determined as failure.

In the measurement of the thickness, random ten places of a uniform thickness were measured with an eddy-current film thickness meter "EDDY560C" (available from HELMUT FISCHER GmbH), and the average was defined as the thickness of the electrostatic latent image carrier.

TABLE 2

| | Toner | | | | | Evaluation of Uneven Charge | | |
|---|---|---|---|---|---|---|---|---|
| | Toner | Toner Matrix Particle | External Additive | | | | After 50,000 | |
| | No. | No. | No. | *1 | *2 | Initial | prints | *3 |
| Example 1 | (Bk-1) | (1) | Silica-Polymer Composite Nanoparticle 1 | 106 | 1.0 | 0.01 | 0.02 | 0.2 |
| Example 2 | (Bk-2) | (3) | Silica-Polymer Composite Nanoparticle 1 | 106 | 1.0 | 0.01 | 0.01 | 0.2 |
| Example 3 | (Bk-3) | (2) | Silica-Polymer Composite Nanoparticle 1 | 106 | 1.0 | 0.01 | 0.02 | 0.2 |
| Example 4 | (Bk-4) | (3) | Silica-Polymer Composite Nanoparticle 2 | 50 | 1.0 | 0.01 | 0.03 | 0.1 |
| Example 5 | (Bk-5) | (3) | Silica-Polymer Composite Nanoparticle 3 | 500 | 1.0 | 0.01 | 0.03 | 0.4 |
| Example 6 | (Bk-6) | (3) | Silica-Polymer Composite Nanoparticle 4 | 45 | 1.0 | 0.01 | 0.04 | 0.1 |
| Example 7 | (Bk-7) | (3) | Silica-Polymer Composite Nanoparticle 5 | 550 | 1.0 | 0.01 | 0.04 | 0.4 |
| Example 8 | (Bk-8) | (3) | Silica-Polymer Composite Nanoparticle 6 | 113 | 1.0 | 0.01 | 0.03 | 0.3 |
| Example 9 | (Bk-9) | (3) | Silica-Polymer Composite Nanoparticle 7 | 95 | 1.0 | 0.01 | 0.03 | 0.2 |
| Example 10 | (Bk-10) | (3) | Silica-Polymer Composite Nanoparticle 10 | 108 | 1.0 | 0.01 | 0.02 | 0.2 |
| Example 11 | (Bk-11) | (3) | Silica-Polymer Composite Nanoparticle 11 | 103 | 1.0 | 0.01 | 0.02 | 0.2 |
| Example 12 | (Bk-12) | (3) | Silica-Polymer Composite Nanoparticle 1 | 106 | 0.3 | 0.02 | 0.04 | 0.2 |
| Example 13 | (Bk-13) | (3) | Silica-Polymer Composite Nanoparticle 1 | 106 | 2.0 | 0.01 | 0.02 | 0.2 |
| Example 14 | (Bk-14) | (3) | Silica-Polymer Composite Nanoparticle 1 | 106 | 5.0 | 0.02 | 0.04 | 0.2 |
| Comparison 1 | (Bk-15) | (3) | Silica-Polymer Composite Nanoparticle 8 | 121 | 1.0 | 0.02 | 0.10 | 0.1 |
| Comparison 2 | (Bk-16) | (3) | Silica-Polymer Composite Nanoparticle 9 | 85 | 1.0 | 0.02 | 0.09 | 0.6 |
| Comparison 3 | (Bk-17) | (3) | Calcium Titanate | 110 | 1.0 | 0.02 | 0.15 | 0.8 |
| Comparison 4 | (Bk-18) | (3) | Strontium Titanate | 110 | 1.0 | 0.02 | 0.17 | 0.9 |
| Comparison 5 | (Bk-19) | (3) | Silica | 100 | 1.0 | 0.02 | 0.14 | 0.8 |

*1: Number Average Primary Particle Size (nm)
*2: Added Amount (pts. mass)
*3: Wear of Electrostatic Latent Image Carrier (μm)

The results in Table 2 evidently show that Examples 1 to 14 according to the process of forming an image according to the present invention exhibit reduced image defects caused by uneven charge of the electrostatic latent image carrier even after 50000 prints to attain high-quality images. The results also show reduced wear of the electrostatic latent image carrier. In contrast, the uneven charge and the wear of the electrostatic latent image carrier are significant in Comparative Examples 1 to 5.

This U.S. patent application claims priority to Japanese patent application No. 2014-093498 filed on Apr. 30, 2014, the entire contents of which are incorporated by reference herein for correction of incorrect translation.

What is claimed is:

1. A process of forming an image, comprising at least steps of:

developing an electrostatic latent image with a toner, the latent image being formed through charge of a surface of an electrostatic latent image carrier and exposure of the surface to light; and applying a lubricant onto the surface of the electrostatic latent image carrier, wherein the toner comprises at least toner matrix particles and external additive nanoparticies, the external additive nanoparticies comprise silica-polymer composite nanoparticles, and a number average primary particle diameter of the silica-polymer composite nanoparticles is within a range of 50 to 500 nm, the silica-polymer composite nanoparticles comprise colloidal silica nanoparticies, and a number average primary particle diameter of the colloidal silica nanoparticies is within a range of 10 to 70 nm, and a percentage of atomic silicon present on the surface of the silica-polymer composite nanoparticles satisfies at least Condition A expressed by Expression: 15.0 atm % ≤ percentage of atomic silicon ({Si/ (C+O +Si)}×100) ≤30.0 atm %, the percentage of atomic silicon being determined from total amounts of atomic carbon, oxygen, and silicon present on the topmost surface of the silica-polymer composite nanoparticles and within 3 nm inwards from the topmost surface, the percentages of the atoms being determined with an X-ray photoelectron spectrometer.

2. The process of forming an image according to claim 1, wherein the toner matrix particles have a domain-matrix structure, the matrix contains a vinyl resin having acid groups, and the domain contains a resin composed of a vinyl polymer segment and a polyester polymer segment combined together.

3. The process of forming an image according to claim 1, wherein a hydrophobic agent used. in the silica-polymer composite nanoparticies comprises at least methacryloxypropyltrimethoxysilane.

4. The process of forming an image according to claim 1, wherein a hydrophobic agent used in the silica-polymer composite nanoparticles comprises at least hexamethyldisilazane.

5. The process of forming an image according to claim 1, wherein the toner matrix. particles have a number average particle diameter of 3 to 8 μm.

6. The process of forming an image according to claim 1, wherein the matrix particles have an average circularity of 0.850 to 0.990.

7. The process of forming an image according to claim wherein the lubricant is zinc stearate.

8. The process of forming an image according to claim 1, wherein the silica-polymer composite nanoparticles consist of the colloidal silica nanoparticies and a polymer prepared with a hydrophobic agent, and a mass ratio of the hydrophobic agent : the colloidal silica nanoparticles is 0.8:1 to 20.0:1.

9. The process of forming an image according to claim 2, wherein the polyester polymer segment is a crystalline polyester.

* * * * *